US007062960B2

(12) United States Patent
Couren et al.

(10) Patent No.: US 7,062,960 B2
(45) Date of Patent: Jun. 20, 2006

(54) BLOW OUT PREVENTER TESTING APPARATUS

(75) Inventors: Patrice Paul Louis Couren, Beziers (FR); Hans Paul Hopper, Whiterashes (GB)

(73) Assignee: Cooper Cameron Corporation, Houston, TX (US)

( * ) Notice: Subject to any disclaimer, the term of this patent is extended or adjusted under 35 U.S.C. 154(b) by 25 days.

(21) Appl. No.: 10/141,720

(22) Filed: May 9, 2002

(65) Prior Publication Data

US 2003/0000693 A1 Jan. 2, 2003

(30) Foreign Application Priority Data

Jun. 22, 2001 (GB) ..... 01305431.7

(51) Int. Cl.
*E21B 47/06* (2006.01)

(52) U.S. Cl. ..... 73/152.51

(58) Field of Classification Search ..... 73/152.18, 73/46, 40.5 R, 152.43, 152.51, 152.53; 166/250, 166/84.3, 85.4; 175/195
See application file for complete search history.

(56) References Cited

U.S. PATENT DOCUMENTS

| | | | | | |
|---|---|---|---|---|---|
| 3,443,643 | A | * | 5/1969 | Jones | 73/152.51 |
| 3,861,463 | A | * | 1/1975 | Crowe | 166/367 |
| 3,924,679 | A | | 12/1975 | Jansen, Jr. | 166/182 |
| 3,955,623 | A | | 5/1976 | Aumann | 166/6 |
| 3,964,305 | A | * | 6/1976 | Wray et al. | 73/152.01 |
| 4,018,276 | A | | 4/1977 | Bode | 166/183 |
| 4,030,354 | A | * | 6/1977 | Scott | 73/152.01 |
| 4,090,395 | A | | 5/1978 | Dixon et al. | 73/40.5 R |
| 4,147,222 | A | * | 4/1979 | Patten et al. | 175/9 |
| 4,159,637 | A | | 7/1979 | Lamb et al. | 73/46 |
| 4,216,536 | A | * | 8/1980 | More | 367/83 |
| 4,337,653 | A | * | 7/1982 | Chauffe | 73/152.43 |
| 4,347,733 | A | | 9/1982 | Crain | 73/40.5 R |
| 4,373,380 | A | | 2/1983 | Mayo | 73/40.5 R |
| 4,384,612 | A | * | 5/1983 | Bradford et al. | 166/66 |
| 4,453,566 | A | * | 6/1984 | Henderson et al. | 137/614.02 |
| 4,466,487 | A | * | 8/1984 | Taylor, Jr. | 166/339 |
| 4,554,976 | A | | 11/1985 | Hynes et al. | 166/341 |
| 4,715,442 | A | * | 12/1987 | Kahil et al. | 166/250.01 |

(Continued)

FOREIGN PATENT DOCUMENTS

| | | |
|---|---|---|
| EP | 0 358 378 | 3/1990 |

(Continued)

OTHER PUBLICATIONS

OTC 6390; J.A. Burton, et al; *Intelligent Running Tool for Subsea Drilling and Completion Equipment Using Acoustical Two-Way Communication Between the Subsea Wellhead and the Surface*;; 22nd Annual OTC May 7-10, 1990 (pp. 4).

*Primary Examiner*—Hezron Williams
*Assistant Examiner*—John Fitzgerald
(74) *Attorney, Agent, or Firm*—Conley Rose, P.C.

(57) ABSTRACT

The consequences of any failure of a blow out preventer assembly to operate correctly in an emergency can be far reaching. Thus, there is provided an apparatus for registering parameters in the bore of a member which is, in use, connected to a pressurised housing, the apparatus comprising: an electro-control package for attachment, in use, to the member; a test assembly placed, in use, in the member; the electro-control package and the test assembly having means for sending signals to and receiving signals from one another.

29 Claims, 15 Drawing Sheets

U.S. PATENT DOCUMENTS 4,731,744 A * 3/1988 Harrell, Jr. et al. ..... 356/617
4,802,143 A * 1/1989 Smith ..... 367/82
4,862,960 A * 9/1989 Garbett ..... 166/87.1
4,881,598 A * 11/1989 Stockinger et al. .... 166/250.08
5,080,182 A * 1/1992 Thompson ..... 73/152.43
5,178,215 A * 1/1993 Yenulis et al. ..... 166/95.1
5,279,365 A * 1/1994 Yenulis et al. ..... 166/84.3
5,860,478 A 1/1999 Coutts et al. ..... 166/356
5,890,541 A 4/1999 Jennings et al. ..... 166/336
5,934,374 A * 8/1999 Hrametz et al. ..... 166/264
6,032,736 A 3/2000 Williams ..... 166/250.08
6,032,742 A * 3/2000 Tomlin et al. ..... 166/345
6,044,690 A * 4/2000 Williams ..... 73/40.5 R
6,070,668 A * 6/2000 Parks et al. ..... 166/345
6,152,225 A * 11/2000 Young et al. ..... 166/250.08
6,236,620 B1 * 5/2001 Schultz et al. ..... 367/82
6,321,846 B1 * 11/2001 Rytlewski ..... 166/363
6,390,194 B1 * 5/2002 Young et al. ..... 166/250.08
6,536,529 B1 * 3/2003 Kerr et al. ..... 166/375
6,557,637 B1 * 5/2003 Dore et al. ..... 166/338

FOREIGN PATENT DOCUMENTS

EP 0 566 382 A1 10/1993
WO WO98 50676 11/1998

* cited by examiner

BLOW OUT PREVENTER TESTING APPARATUS

CROSS-REFERENCE TO RELATED APPLICATIONS

This application claims a right of priority based upon European Patent Application No. 01305431.7, as filed in the European Patent Office on Jun. 22, 2001.

STATEMENT REGARDING FEDERALLY SPONSORED RESEARCH OR DEVELOPMENT

Not Applicable.

BACKGROUND OF THE INVENTION

1. Field of the Invention

This invention relates to a testing apparatus to test a Blow Out Preventer (BOP) stack or assembly and to a method of testing using such an apparatus.

2. Description of the Related Art

A BOP assembly is a multi closure safety device which is connected to the top of a drilled and often partially cased hole. The accessible top end of the casing is terminated using a easing spool or wellhead housing upon which the BOP assembly is connected and sealed.

The wellhead and BOP stack (the section in which rams are provided) must be able to contain fluids at a pressure rating in excess of any formation pressures that are anticipated when drilling or when having to pump into the well to suppress or circulate an uncontrolled pressurized influx of formation fluid. This influx of formation fluid is known as a 'kick' and restabilizing control of the well by pumping to suppress the influx or to circulate the influx out under pressure is known as 'killing the well. An uncontrolled escape of fluid, whether liquid or gas, to the environment is termed a 'blow out'. A blow out can result in a major leak to the environment which can ignite or explode, jeopardizing personnel and equipment in the vicinity, and pollution.

Although normal drilling practices provide a liquid hydrostatic pressure barrier to a kick, a final second mechanical safety barrier is provided by the BOP assembly. The BOP assembly must close and seal on tubular equipment hung or operated through the BOP assembly and ultimately must be capable of shearing and sealing off the well. Wells are typically drilled using a tapered drill string having successively larger diameter tubulars at the lower end. When running a completion or carrying out a workover various diameter of tubulars, coiled tubing, cable and wireline and an assortment of tools are run.

The consequences of any failure of the BOP assembly multi closure barriers and valves, shear and seal devices to correctly operate in an emergency can be far reaching. It is essential to initially contain the kick to prevent a blow out and then be capable of killing the well, and re-establishing control.

To verify the functions and performance of a BOP assembly, stringent tests have to be performed on a regular bases, either daily, weekly or at certain stages of the drilling operation to ensure the BOP is in full working order. When drilling or carrying out well intervention on a subsea well where the wellhead is at the seabed, the subsea BOP attached to the subsea wellhead is connected to a buoyant floating drilling vessel by a riser. A floating drilling vessel should maintain its station vertically above the well to enable well operations to be performed.

Failure to do so caused by weather conditions, current forces, equipment malfunctions, drift off or drive off, fire or explosion, collision or other marine incidents means it is necessary if possible to make the well safe, isolate the well at the seabed and disconnect the riser system. In a severe emergency, shearing any tubulars or equipment in the BOP bore, sealing the well to full working pressure and disconnecting the riser system is required to be achieved in under 30 seconds.

A conventional BOP assembly, surface or subsea, is attached to a wellhead and is provided with a number of ram BOPs to either seal around different set tubular diameters or to shear and seal the bore. These ram BOPs should be rated to perform at pressures in excess of any anticipated well pressures or kick control injection pressures being approximately 10 to 15 kpsi (69–103 MPa). A minimum of one annular BOP is provided above the ram BOPs to cater for any tubular diameter or for stripping in or out under pressure. An annular BOP is a hydraulically energized elastomeric toroidal unit that closes and seals on varying diameters of tubular member whether stationary or moving into or out of the well. Due to the nature of this pressure barrier element, a lower maximum rated working pressure of about 5 kpsi (34 MPa) is normally available.

Above the annulars, there are no further well pressure barrier elements with the riser only providing a hydrostatic head, liquid containment and guidance of equipment on a normal pressure controlled drilling operation. For a subsea riser system, the hydrostatic head of the different drilling liquids over the ambient sea water pressure means the low pressure zone above the subsea BOP assembly must still withstand, depending upon the depth of water, 5 kpsi (34 Mpa).

The conventional BOP assembly in effect provides a three zone pressure containment safety system. The three zones typically consists of the first high pressure lowermost section encompassing the rams, the medium pressure second zone, the annular or annulars and the low pressure third zone being the bore above to atmosphere and on a subsea system the riser bore to the surface vessel.

It is therefore important to be aware that BOP assemblies need to be tested rigorously in order to verify their full working order and that any potential problems can be identified and rectified before any emergency arises in order to maintain the integrity of a BOP assembly once it is in place. in deep water, BOP assemblies could remain subsea for several months. It is necessary for it to be fully tested at regular intervals and, throughout the subsea industry, this is typically at least once every week.

It is important therefore that the tests on the BOP assembly are carried out carefully and methodically to detect any potential problems but in a reasonable time to minimize risk exposure as testing prevents further downhole well operations especially if the well is open being partially drilled or when involved in a completion or work over. In the case of subsea wellheads which can be at a water depth of as much as 10,000 feet (3050 m), it typically takes approximately three to four hours plus to run the test apparatus into place and three to four hours plus to pull back to the surface after testing has been completed. A typical test sequence takes approximately 6 hours plus to complete if there are no queries or questionable readings. Thus, it is not unusual for a well to be out of operation for approximately 12 hours per week. This is clearly very significant in terms of risk exposure and lost revenue for the well owners and anything which can reduce the well downtime is therefore of great benefit.

Diagnosing any queries or questionable readings can take time even on an integral system, the variety being due to fluid compression, thermal changes of the fluids or to the equipment containing the fluids, riser/vessel movement and the large volumes in the choke and kill lines to the surface in comparison to the relatively small volumes of the BOP cavities and that of a small leak.

A faulty diagnosis or incorrect interpretation due to vague information could lead to the well being temporarily suspended and the BOP assembly being pulled. In deepwater it could take 6 days plus before well operations are resumed.

It is normal procedures when testing the BOP assembly to use a drill pipe or a test mandrel connected above a wellhead tool that will seal within the wellhead. It is also known to try to combine some of the BOP assembly tests with wellhead and surface manifold testing. When testing the BOP assembly it is necessary to ensure that all of the valves, seals, rams and annulars are tested to their maximum expected usage pressure. Each pressure test should be started by a minimum 5 minute low pressure test (e.g. at 300 psi) and then raised in increments to the final high test pressure. Typically, a wellhead/BOP test pressure that is stable and recorded for a minimum of 5 minutes is considered satisfactory. BOP rams are only designed to seal off pressure from below which means all tests have to be carried out either against the wellhead test tool or the well bore. The usual practice is to supply the test pressure to the BOP cavity under test alternating between the choke and kill lines to allow all functions on each side of the BOP stack to be tested from the bore outwards.

When testing the BOP assembly cavities around the test tubular, the BOP test pressures at certain stages of the well could exceed the pressure rating of the well casing so far installed. If a leak occurred from the BOP bore test past the wellhead test tool, the well could be pressured up and be hydraulically fractured, thus making the well unusable. To prevent this occurring the well fluid is allowed to vent up the bore of the wellhead test tool into the bore of the drill pipe where any leak can be monitored on the surface. One particular and critical test is the integrity of the shear blind ram BOP cavity. The shear blind rams are those which can cut the drill string or a pipe or tubing and then seal the BOP bore when there is a need to carry out an emergency disconnect of the riser system from the BOP stack. This, in effect, is the last and only resort for shutting down the well as when the pipe rams are closed on a tubular, the bore of the tubular is still open. Typically, the testing of the shear blind rams requires disconnecting the drill pipe or part of the test mandrel below the shear blind rams and pulling the upper part clear such that the shear blind rams can close.

However, after the mechanical release from the lower part of the test mandrel attached to a wellhead test tool, the bore through the remaining test equipment into the wellhead must be isolated to test up under the shear blind rams. This can be achieved by using either a one way flow mechanism which has the possibility to weep or leak, pressuring up the well casing or alternatively by tripping out of the hole and running a solid wellhead test tool. Either way, after the mechanical release or if a solid wellhead test tool is run, the integrity of the wellhead test tool to seal off in the wellhead cannot be verified before tested.

Even though the shear blind ram BOP cavity is a critical zone to test, the consequences of jeopardizing the integrity of the well casing is deemed too high a risk. Therefore, it is normal practice to test the shear blind ram BOP cavity only to the operationally safe allowable low casing working pressure using either no wellhead test tool or a test tool knowing that, if it leaked, no well damage can occur.

Furthermore, the test liquid pumped and measured on the vessel is supplied at the test pressure typically through either the choke or kill lines down to the appropriate test path into the subsea BOP bore. In addition, this conventional test procedure using the choke and kill lines involves a high volume relative to the small tested cavity volume above the wellhead test tool and in relation to any leaks, meaning that it is difficult to detect leaks.

To reduce premature damage to equipment and function elements, the operation and resetting of the BOP barriers means the valves, rams and annulars should only be opened or closed in a depressurized bore.

Therefore, the choke and kill lines must be vented down between each cavity test, i.e. they are depressurized and repressurized with tests only commencing after the pressure has balanced and stabilized. This is a time consuming process which greatly lengthens the testing time. The compressibility of the drilling liquids, usually drilling mud, and possible expansion or elongation of the lines to the BOP and variations in temperature all contribute to the difficulty of monitoring very small changes in the volume. A wise practice is to circulate the system with seawater which can reduce these effects but not eliminate them entirely.

Once a stable test pressure is achieved, the current BOP testing technique is to surface monitor the test pressure and establish a decay profile. However, when testing, there is a degree of interpretation required as to whether the decays are caused by the above mentioned side effects or a leak. This interpretation has to be carried out by personnel at the surface of the well and is based on experience and judgement rather than facts.

When drilling a well, the prime barrier to prevent an influx of formation fluid is provided by the hydrostatic head of the drilling mud column. It is essential that the consistency and properties of the drilling mud are as specified for certain sections of open hole. This is achieved by circulating a constantly surface trimmed liquid at a designated rate in relation to the liquid properties. In addition, any traces of an influx can be detected by the surface monitoring systems on the return line.

A stationary column of well liquid could unknowingly allow migration of formation fluid into the well bore and the properties of the well liquid could change due to deterioration, thus creating an unstable situation which could result in a kick. Therefore, allowing an open hole to stand stationary for any period of time is an unwise practice. Also, if a kick occurs, the optimum solution is to circulate the kick out under pressure which involves having a tubular member in the hole below the influx and preferably near the bottom of the hole.

Therefore, when having to test a BOP on a well with a balanced open hole, it is a wise practice to use part of the drilling string hung-off below the wellhead test tool. This means that after completing the BOP testing, the well fluids can be circulated and conditioned prior to opening the BOP and pulling the string up to remove the test tools. If a kick has occurred or occurs while pulling out of the riser, the BOP rams can be closed on the drill string and the well circulated. This cannot be achieved if there is a one-way upward flow mechanism in the wellhead test tool or a solid wellhead test plug has been used which would prevent circulation, endangering the operation.

U.S. Pat. No. 4,554,976 discloses a means of testing the shear blind rams of a BOP by splitting the tool into upper and lower portions. In order to test the rams, the upper portion of the tool is removed, the rams tested, and the tool reconnected before withdrawing the tool from the BOP.

U.S. Pat. No. 6,032,736 (Nutec) discloses a test mandrel for use in subsea testing of BOPs which allows the BOP test fluid to be pumped down the drill pipe to a telescopic arrangement. However, this has inherent problems due to possible leakage between the seals of the telescopic portions which makes it very difficult to distinguish a failed BOP. Accounting for the different heights of the wellhead test plug at different stages of the well is accounted for by using spacer pipes between the wellhead test plug and the telescopic test tool. Circulation of the well after testing is not possible unless wireline is run down the drill pipe to remove the blanking dart.

Also monitoring for leaks from around the wellhead test tool is via the test assembly into the drilling riser which has an immense volume in deep water. A means of testing the shear blind rams is not discussed.

SUT Paper (Society of Underwater Technology, UK)—"Acoustic BOP Test Tool" provides additional screwed sections of pipe which can be added to the drill pipe or test mandrel such that the tubular section can be set at the right height in the BOP stack for the different drilling phases.

This would also cater for the use of different wellhead test tools and to land in the wellhead at the different landing shoulders provided by the different casing hangers/seal assemblies as the well is drilled. The height of the tubular test assembly can be changed to meet the BOP space out. An acoustic pressure emitter can be included in the lower part of the test mandrel which transmits the pressure readings up the drill pipe to the surface. A mechanical communication path is required between the emitter and the surface. Again, circulation of the well and testing of the shear blind rams has not been discussed.

This description has mainly addressed the testing of BOP assemblies as multi-closure safety devices as a barrier in the drilling mode. Similar criteria applies when the BOP assembly is used when installing a completion in combination with a completion riser which means the BOP assembly is a critical high pressure isolation mechanism.

SUMMARY OF THE PREFERRED EMBODIMENTS

This invention is a system and technique which can accurately quantify tests and improve testing practices, jointly raising the level of safety and the commercial aspect of the well operation.

According to the present invention there is provided an apparatus for registering parameters in the bore of a member which is, in use, connected to a pressurized housing, the apparatus comprising:

an electro-control package for attachment, in use, to the member;

the test assembly placed, in use, in the member;

the electro-control package and the test assembly having means for sending signals to and receiving signals from one another.

Preferably, the test assembly is one of the following: blow out preventer test assembly, wellhead tubing hanger running tool, spool tree or horizontal tree tubing hanger running and test tool, casing and seal assembly running tool, subsea test tree, wireline or coil tubing tool, hanger or plugs.

According to a second aspect of the present invention, an apparatus for testing closure elements in a blow out preventer (BOP) forming a BOP assembly which is, in use, connected to a wellhead, the apparatus comprising a shearable test tool assembly for use in combination with the BOP assembly and the wellhead;

an electro-control package for attachment, in use, to the BOP;

the test tool assembly and the control package having means for sending signals and receiving signals from one another.

Preferably, the electro-control package is replaceable.

Preferably, the means for transmitting and receiving signals includes a plurality of emitters and transceivers.

Preferably, the emitters and/or transceivers use one of optical, electrical, electromagnetic, radio, hydraulic pulses or acoustic means as input and output for communication.

The test tool assembly may have sensing means for monitoring parameters inside and outside the tool bore, and for both above and below the tool. These parameters may include at least one of the following: pressure, temperature, velocity, density, and phase detection. The phase detection is preferably one of the following: drilling mud, cement, gas, oil, water and completion fluid.

Preferably, the control package has independent sensing means for monitoring the parameters in a BOP bore above the wellhead. Furthermore, the control package may have means for sending signals to and receiving signals from a control station.

The BOP assembly preferably includes at least one annular and at least one set of rams for sealing the bore of the member to create a test chamber.

In general, and especially when using subsea applications, the test tool is preferably connected to the surface only by means of a mandrel which may be split into upper and lower sections that are run on drill pipe or tubulars from the surface.

One difference between the present invention and conventional BOP testing means is that the apparatus of the present invention preferably lands in a specific location in the wellhead. Thus, instead of landing on components in the wellhead which vary with height as the well is drilled, a datum height is always used, ensuring that the assembly of the present invention is at a constant attitude within the BOP. Preferably, the assembly is landed on the wellhead internal lock and seal profiles for the wellhead running tool. If the wellhead components, which vary with height need to be tested, specific nose adapters may be fitted to the test tool.

If no specific landing shoulder or stop is available in the wellhead body, then the specific nose adapters or nose spacers landed on the respective wellhead component can ensure the apparatus is landed at a specific elevation.

By using a datum level which may be a slight reduction in the internal diameter of the wellhead housing, and therefore a known landing site, a datum anti torque resistance is registered when the test tool is located in the wellhead. Preferably, left hand rotation is used to lock the test tool into the wellhead and preferably high torque right hand rotation is available to release the test tool, without the risk of unscrewing the drill pipe. In this arrangement, left hand rotation preferably drives a cam in the test tool to energized locking dogs which lift the tool off the datum ledge and into the specific internal load bearing profile. This ensures that there is no deformation of the indicator profile on the datum ledge when the test tool is subjected to high pressure loads. In this way, the tool is sealed to the wellhead and the conventional annulus flow through path through the body of the tool is also sealed.

Typically, there is a hanging drill string below the test tool assembly and, in order to prevent this drill string having to be rotated and, thus, causing resistance, a pressure sealing swivel may be incorporated into the lower end of the test tool.

A test tool intelligent monitoring unit may be incorporated within the test tool, the monitoring unit can check data within the bore of the tool, and external to the bore, and both above and below the tool. In this way, pressure and temperature can easily be registered. Alternatively density phase sensors, flow meters, the rotation, tension and torque in the mandrel can also be monitored.

The electrical control package is preferably mounted on the BOP below the lower ram on a spare choke/kill outlet. The control package preferably includes actuated fluid control valves and chokes which provide double barrier fail closed isolation, fluid flow meters and, when a high pressure control line cannot be provided, a fluid intensifier.

Via the intelligent monitoring unit and the control package, surface personnel can readily monitor read/hear functions occurring at the wellhead and verify that the device is operating correctly.

The test tool may also comprise a one way upward flow valve located in the bore, the one way upward flow valve allowing fluid to escape from below the test tool. This flow path ensures that the well casing cannot be pressured up if there is a leak from the BOP bore past the test tool. The one way upward flow valve preferably comprises parallel seals which prevent the flow from cutting the seals or the sealing area. It is essential that this one way upward flow valve is reliable as, when the mandrels are separated in order to test the shear/blind rams, full test pressure will be exerted down the bore to the top of the one way upward flow valve. This full test pressure must not be allowed to enter the bore as this will pressure up the well and may damage the well casings.

As stated above, the test mandrel is split into upper and lower portions, joined by a mandrel coupling. Preferably, a hydraulic operated anti left hand rotation mechanism is incorporated into this coupling such that, when pressure is applied down the drill pipe against the one way upward flow valve, the anti left hand rotation mechanism is released, preferably by energizing a spring.

A bladder arrangement may be provided to prevent drilling mud clogging the mechanism. The bladder arrangement separates the hydraulic fluid from any drilling mud or sea water. Preferably, the mechanism is low torque, such that the tool can be unlocked without any vertical separation of the upper and lower mandrels. A conventional screw thread would lock up under either the weight or tension caused when operating from a heaving vessel.

During operation, the coupling system will lock out, thus preventing further rotation. This can be registered on the surface and the low pressure in the drill pipe can be vented down. Then, the drill pipe/upper mandrel can be pulled up, separating the coupler without dislodging the test tool which is locked and sealed in the wellhead. This allows the shear blind ram cavity to be fully tested to the maximum anticipated well pressure against the test tool, which has its bore isolated by the one way upward flow valve.

Pressure read outs can be taken from the BOP bore and from below the test tool to confirm any well casing is not being pressured up. When testing the shear blind rams, it is preferable that the upper mandrel is pulled up against, and sealed by, an upper annular prior to closing the shear blind rams.

Even if a pressure drop is noted, this does not specifically identify the location of the leak. The present invention permits separate and simultaneous monitoring of fluid flow on the choke and kill lines, the riser, booster line and through the drill pipe/upper mandrel, in particular to monitor any escape of fluid from the test chamber. After a successful test of the shear blind rams, the upper mandrel is preferably lowered and stabbed together, engaging and intermeshing anti rotation features on the couplings and these may be key slots on both couplings. With downward weight binding the test tool, right hand rotation will drive the mandrel coupling cam mechanism to lock the upper coupling to the lower coupling. The anti left rotation locks are in effective to right hand rotation. Again, when fully locked, a build up of torque will be seen at the surface and upward pull against the locked test tool verifies full load carrying make up is achieved. At this point, any sea water in the kill line, BOP, choke line and booster line should be replaced by drilling mud.

In the arrangement where the bore protector or wear bushing is to be left in place, it is preferred that the pressuring up of the drill pipe releases the wear bushing. By picking up the total drill string hanging weight, right hand rotation will open up the annulus flow through path, unseal and unlock the test tool. With pressure held on the drill pipe, the test tool can be pulled clear of the wear bushing.

The apparatus preferably includes a drop dart which can be released down the drill pipe to land and seal in the circulation sleeve of the test tool, in order that the well can be circulated prior to pulling the tool out of the hole. A hydraulic lock is formed between the dart and the circulation sleeve and the one way upward flow valve and therefore no circulation would occur. To overcome this, the circulation sleeve has a dual flow design which is activated by the dart depressing a spring loaded plunger in the circulation sleeve, thus venting fluid below the dart into a circulation port exiting below the tool. Pressure can now be applied down the drill pipe to allow the dart/sleeve to move down, thus opening a circulation path from the bore above the test tool to the bore below. The circulation port bypass the one way upward flow valve and neutralize the wear bushing hydraulically operated latch dogs. The BOP control package can verify the bore pressures and circulation pressures. In this way, the well can be circulated and, as the test tool is pulled out, fluid will equalize down the drill pipe, thus allowing a dry string to be pulled.

In the situation when premature well circulation has to be carried out, wire line or coil tubing can be run to retrieve the dart. As the dart is pulled, sealed friction or spring friction contacts will pull the circulation sleeve up into the closed position, thus returning the test tool to the test mode.

A further application of the apparatus of the present invention is as an emergency planned hang off tool.

Additionally, if a bad weather forecast is received when drilling the well, and a decision is made to suspend operations, the drill string can be pulled up to the last casing shoe, plus the water depth. The test assembly with a one way downward flow mechanism is inserted and locked in the bore between the test plug and the mandrel before being connected to the drill pipe and run down to the wellhead where the test tool assembly can then be locked and sealed to the wellhead. The surface installed one way downward flow mechanism unit will, on a surface installation, depress the plunger and move the circulation sleeve into the open position. This will allow a downward circulation through the bore but will isolate any pressure in the bore below the test assembly. The test tool will provide the bore upward barrier and an annulus barrier, which closes the well flow through path, prior to disconnecting the mandrel coupling and closing the shear blind rams. This arrangement thus provides independent mechanical double barrier isolation of the well, first in the wellhead and then by the BOP.

When returning after a disconnection of the BOP and riser, the internal pressure conditions of the BOP can be monitored prior to opening any barriers, due to the electro-control package.

The electro-control package may inject fluid into, or vent fluid from, the BOP bore at a known pressure and volume, preferably at the required test pressure. This allows simultaneous testing of the ram or annular barrier, the choke side and the kill side of the BOP bore.

The apparatus of the present invention can be used to carry out a full test procedure on the BOP and the wellhead and it permits the number of steps to be reduced thus ensuring the well down time is reduced and the cost effectiveness of any installation is improved.

Furthermore, the BOP allows the blind shear rams to be tested which, as referred to above, although vital, is often or even usually not carried out to the full working pressure. The testing procedure is carried out once the test assembly has landed at its datum height at the top of the wellhead housing. The test procedure should follow the operator's program.

Thus, the present invention comprises a combination of features and advantages which enable it to overcome various problems of prior devices. The various characteristics described above, as sell as other features, will be readily apparent to those skilled in the art upon reading the following detailed description of the preferred embodiments of the invention, and by referring to the accompanying drawings.

BRIEF DESCRIPTION OF THE DRAWINGS

One example of the present invention will now be described with reference to the accompanying drawings, in which:

FIG. 8*a* shows a cross-sectional view of the release mechanism;

DETAILED DESCRIPTION OF THE PREFERRED EMBODIMENTS

Figure 1:
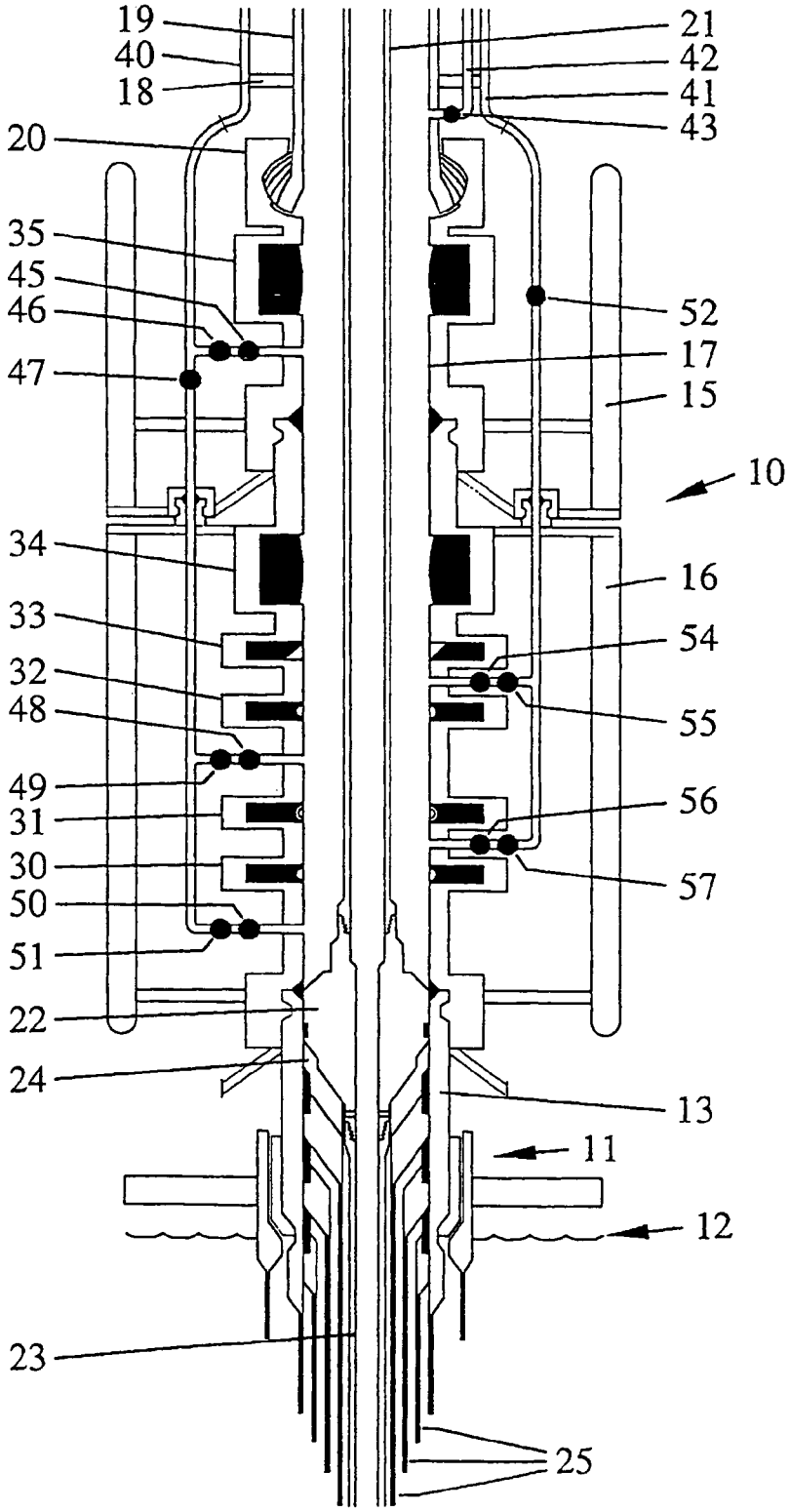
Fig 1 PRIOR ART
FIG. 1 is a schematic longitudinal cross sectional view through a conventional subsea BOP and test assembly.

One of a number of conventional subsea BOP well assemblies 10 is shown schematically in FIG. 1. A wellhead 11 is formed at the upper end of a bore into the sea bed 12 and is provided with a wellhead housing 13. The BOP assembly 10 is, in this example, comprised of a BOP Lower Riser Package (LRP) 15 and a BOP stack 16. The LRP and the BOP stack are connected in such a way that there is a continuous bore 17 from the lower end of the lower part through to the upper end of the upper part of the BOP assembly. The lower end of the BOP stack is connected to the upper end of the wellhead housing 13 and is sealed in placed. The upper end 18 of the LRP is connected to the riser pipe 19 and connects the BOP assembly 10 to a surface structure (not shown).

Within the bore 17 and riser pipe 19, a drill pipe or a tubular member 21 is provided and this is connected, at its lower end, to a test tool 22. The test tool is landed on the internal wellhead components and seals to the wellhead housing. At the lower end of the test tool 22, a further tubular 23 is provided and extends into the bore beneath the sea bed 12. Wear bushing 24 and various well casings 25 have previously been set in the wellhead housing 13.

The BOP stack is provided with a number of valve means for closing both the bore 17 and/or the tubular 21 and these include lower pipe rams 30, middle pipe rams 31, upper pipe rams 32 and shear blind rams 33. These four sets of rams comprise the high pressure zone in the BOP stack and they can withstand the greatest pressure. The lower, middle and upper pipe rams are designed such that they close around the drill pipe or tubular member 21. Of course, when the lower, middle and upper pipe rams are closed, whilst the bore 17 is sealed, the bore of the tubular 21 itself is still open. Thus, the shear blind rams are designed such that, when operated, they can cut through any tubular or drill pipe which may be in the bore 17 and provide a single barrier between the upwardly pressurized drilling fluid and the surface.

In the medium pressure zone, above the shear blind rams 33, lower annular 34 and upper annular 35 are provided and these annulars also seal around the drill pipe or tubular member 21 when they are closed.

The low pressure zone is located above the upper annular 35 and includes the flex joint 20 connected to the riser 19. The pressure containing means in this zone is merely the hydrostatic pressure of the fluid which is retained in the bore open to the surface.

Extending from the sea surface to the BOP assembly are choke 40, kill 41 and booster 42 lines for the supply of fluid to or from the BOP stack. The booster line 42 is in fluid communication with the bore 17 via a booster line valve 43 and enters the bore 17 above the flex joint 20. The choke line 40 is in fluid communication with the bore 17 in three locations, each location having an individual branch which is controlled by a pair of valves. The uppermost valves are inner 45 and outer 46 gas vents and the branch on which they are located extends into the bore 17 below the upper annular 35. The choke line 40 extends, past the inner and outer gas vents, through a choke test valve 47, and enters the bore 17 via upper, inner 48 and outer 49 choke valves above the middle pipe rams 31 and via lower, inner 50 and outer 51 choke valves below the lower pipe rams 30.

On the opposite side of the BOP stack, the kill line 41 is equipped with a kill test valve 52 before the kill line 41 enters the bore 17 at two locations, again each of which is via a pair of valves; upper, inner 54 and outer 55 kill valves and lower, inner 56 and outer 57 kill valves respectively. The upper branch is between the upper pipe rams 32 and the shear blind rams 33 and the lower branch is between the lower 30 and middle pipe 31 rams.

Figure 2:
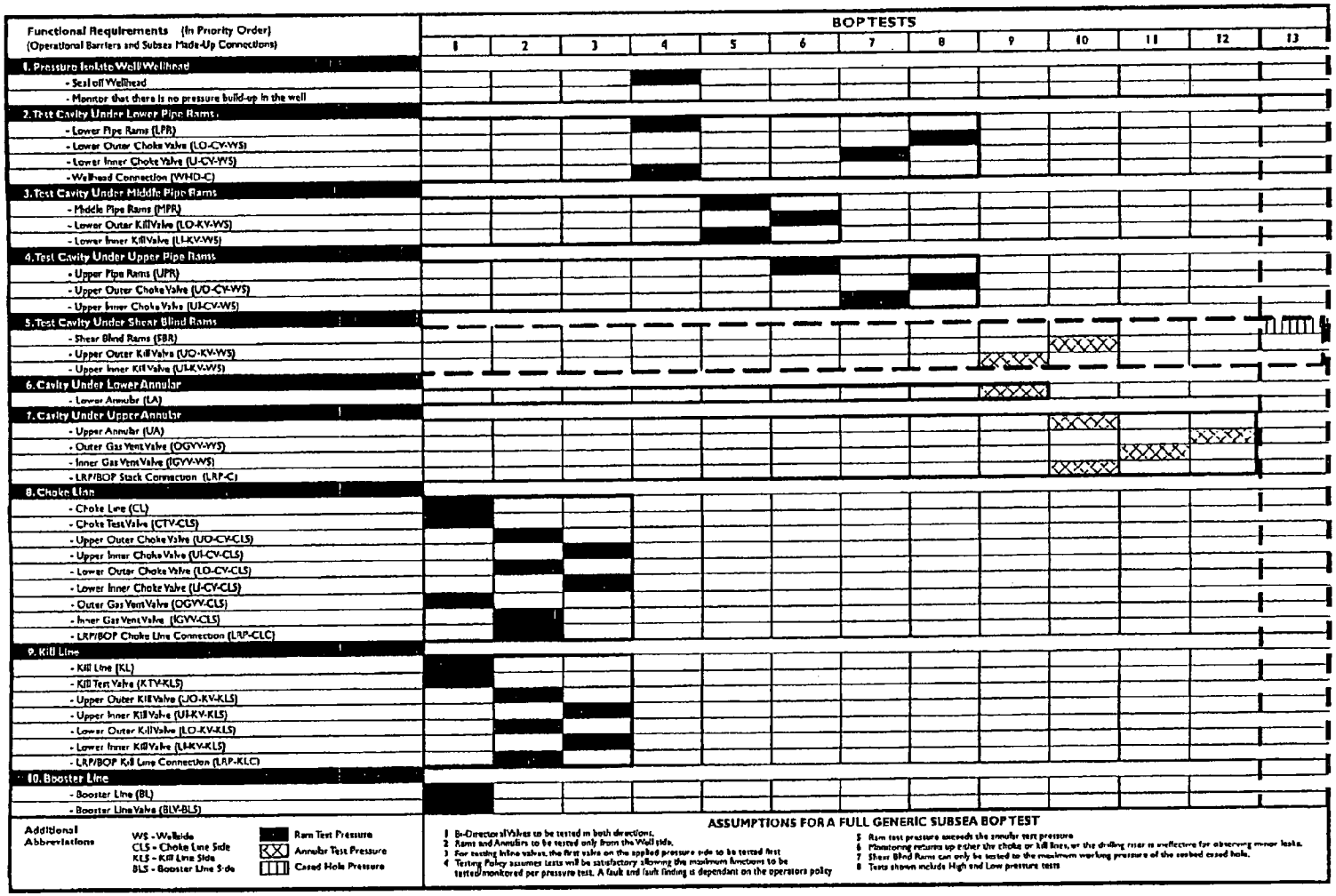
Fig 2 PRIOR ART
FIG. 2 is a summary of the testing requirements of a conventional subsea BOP assembly.

In FIG. 2, a summary of the full test requirements of a conventional subsea BOP can be seen and it is clear that at least 13 steps are required to test the conventional arrangement. This can be compared with the suggested test schedule associated with the present invention shown in FIG. 14.

Figure 3:
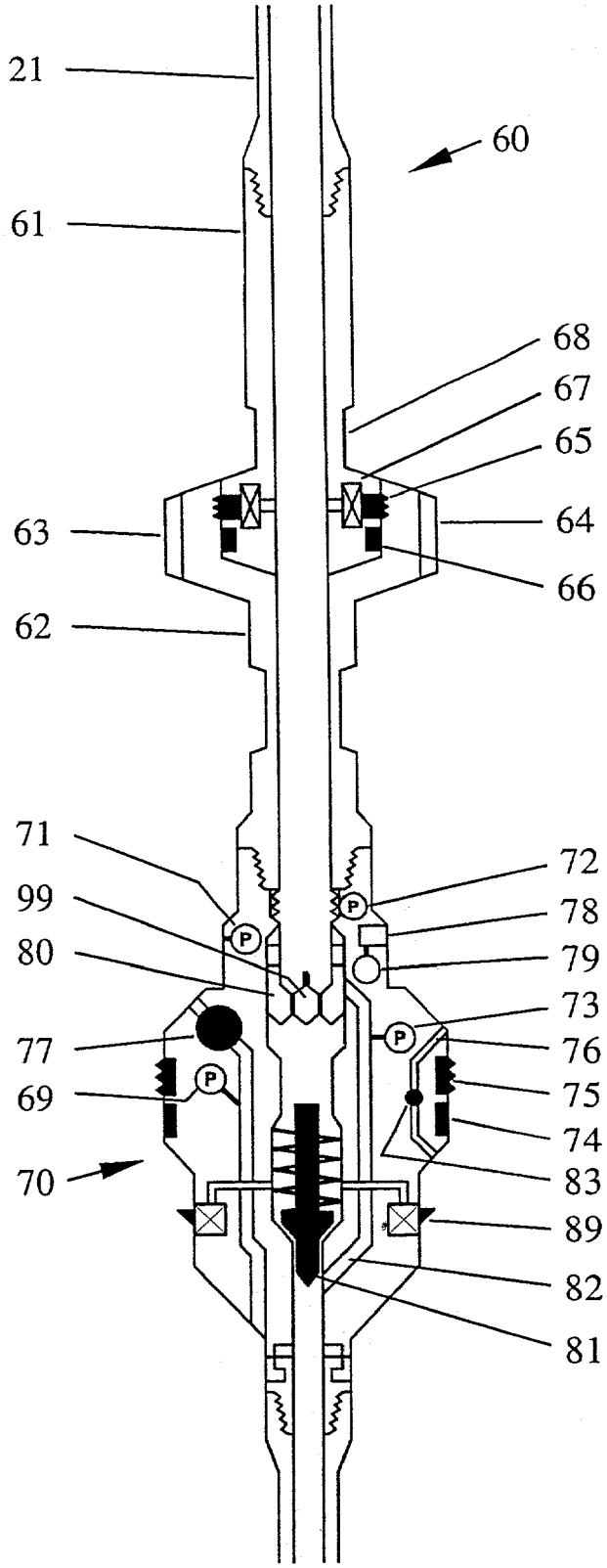
FIG. 3 is a schematic longitudinal cross section through a wellhead test tool assembly for use in the present invention.

In FIG. 3, a wellhead test tool assembly 60 is shown and is comprised of an upper mandrel 61 and a lower mandrel 62. The upper and lower mandrels are connected by means of a mandrel coupling 63. The upper mandrel 61 is connected, at its upper end, to drill pipe 21 and the lower mandrel 62 is connected, at its lower end, to a wellhead test plug 70.

The mandrel coupling 63 has, on its outer diameter, an annular return swedge 64 and has a number of cams (see FIG. 8) which, when operated by right hand rotation of the upper mandrel, engage with dogs 65 to lock the upper and lower mandrel together. Seals 66 are provided to ensure a fluid tight connection. The mandrel coupling 63 is also provided with hydraulic means 67 for overriding the anti left hand rotation of the coupling. The lower section of the upper mandrel has a narrowed portion 68 which is, in use, at the same level as the shear blind rams 33 to facilitate emergency shearing of the upper mandrel if necessary during an emergency.

The test plug 70 has a number of sensors for monitoring the pressure within various parts of the test plug and these include a BOP bore pressure sensor 71, a lower pipe annulus pressure sensor or wellhead/pipe chamber sensor 69, a drill pipe pressure sensor 72 and a lower pipe bore pressure sensor 73 which measures the pressure in bypass passage 82 and below the test plug 70. Seals 74 ensure a fluid tight seal between the wellhead test plug and the wellhead. The test plug 70 is provided with cams, (not shown) which, when operated, lock a number of dogs 75 such that the test plug is securely connected to the wellhead shown in FIG. 4.

When open, a passageway 76 is provided as a bypass for the wellhead seal. A second passageway 77, also valved, is provided as a further bypass of the test tool. A signal receiver/transmitter 78 and associated electrical source 79, which may be a battery, relay the measured pressure from sensors 69, 71, 72 and 73 to the control package and/or to a surface control station. The function and operation of circulation sleeve 80 and one way upward flow valve 81 is discussed with regard to FIGS. 9,10 and 11.

Figure 4:
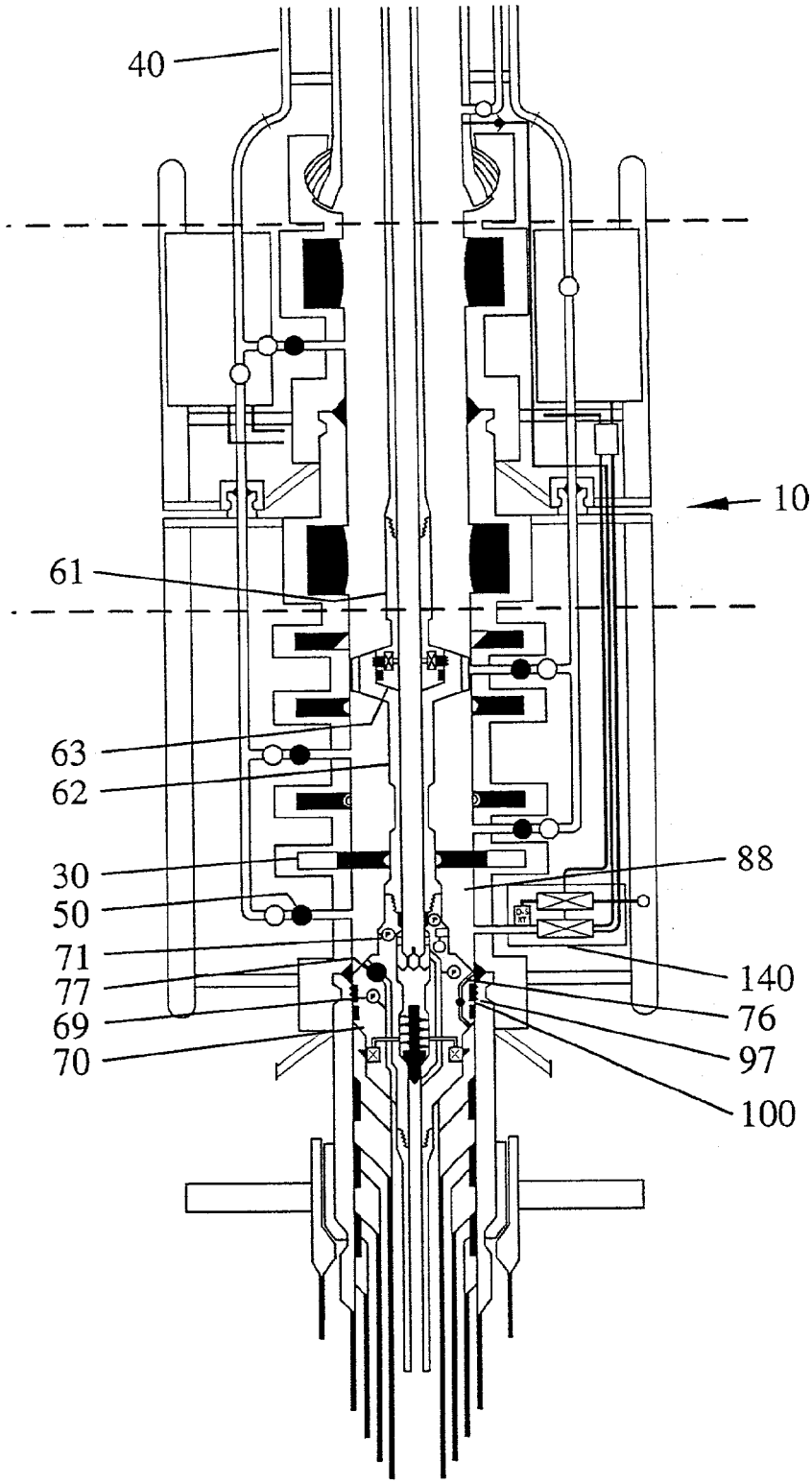
FIG. 4 is a schematic longitudinal cross section showing the assembly of FIG. 3 in a BOP assembly during testing.

FIG. 4 shows the arrangement of the BOP assembly 10 and the wellhead test tool assembly when in place and carrying out a test on the lower pipe ram 30. Also shown in FIG. 4, and provided through a port below the lower pipe rams is an electro control package 140, the details of which will be described more fully with reference to FIG. 13. When the lower pipe rams 30 are in the closed position and the lower inner choke valve 50, the flow port valve 77 and the wellhead seal bypass port 76 are in the closed position, a chamber 88 is formed and the pressure within this chamber can be monitored by means of BOP bore pressure sensor 71 and by a additional pressure sensors in the control package 140. The pressure and flow within the choke line 40 is also monitored to check the integrity of the lower inner choke valve 50.

Figure 5:
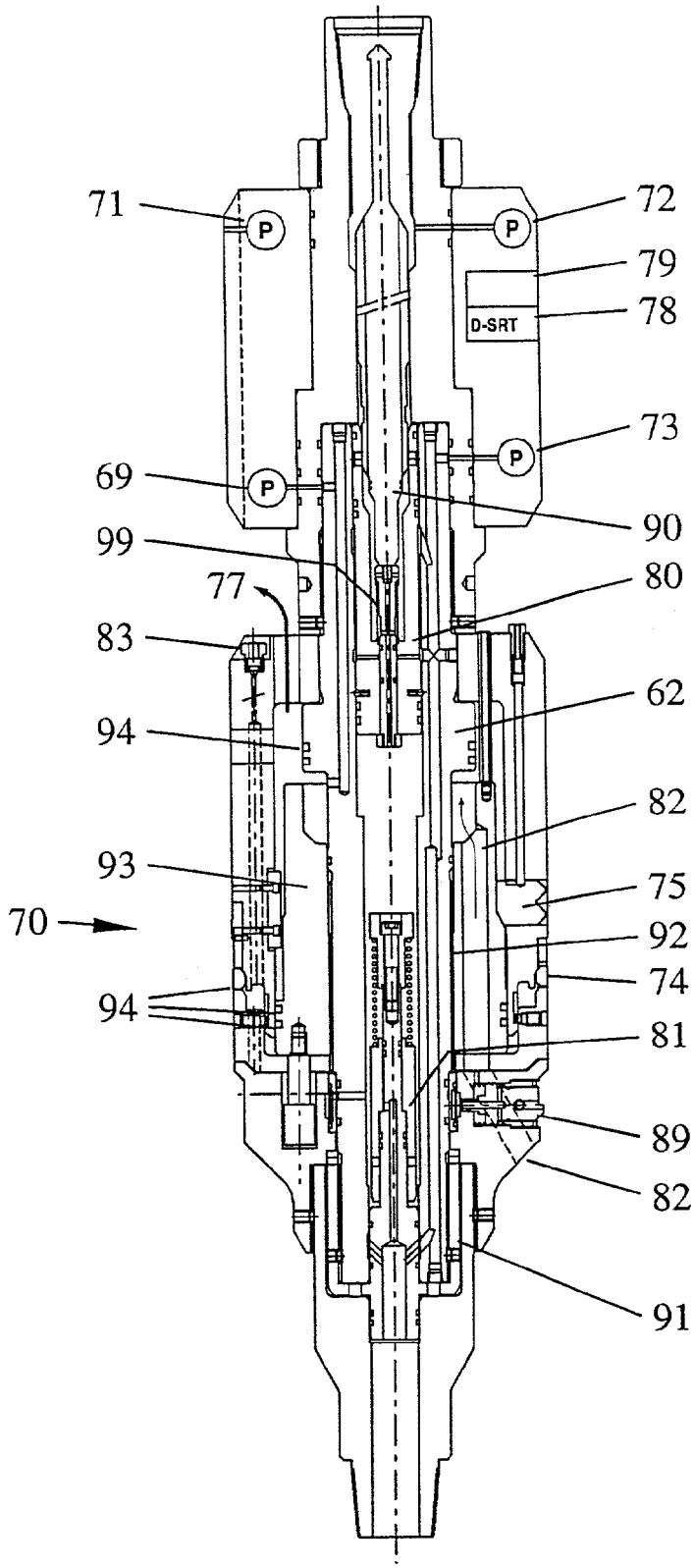
FIG. 5 is a longitudinal cross sectional view through a wellhead test plug.

A more detailed cross section of the wellhead test plug is shown by FIG. 5. In particular, the pressure sensors 69, 71, 72 and 73 and the data-signal receiver/transmitter 78 and associated electrical source 79 are located at the upper end of the test plug. The data signal receiver/transmitter is used to send and receive signals to and from the control package 140 and/or a control station on the sea surface. The circulation sleeve 80 is shown in its upper, flow preventing position. When the sleeve is actuated to its lower position, it permits bypass flow past the high pressure check valve 81. The test plug 70 is provided with bore pressure hydraulic retract wear bushing latch dogs 89 which, when the drill pipe is pressured up, release the wear bushing. The one way upward flow valve 81 is spring energized closed. A loaded plunger 99 is activated by a dropped dart 90 which depresses the plunger in the circulation sleeve 80 which then allows fluid to be vented from below the dart into a circulation port which exits below the tool and prevents a hydraulic lock. This then ensures that pressure can be applied down the drill pipe to allow the circulation sleeve 80 and the dart 90 to move down and open a circulation path from the bore above the test plug 70 to the bore below. At the lower end of the test plug 70, a pressure sealing swivel 91 is incorporated to prevent any hanging drill string having to be rotated with the test tool. Preferably, a left hand thread 92 ensures that it is left hand rotation which locks the test tool into the wellhead by driving a cam 93 which energizes locking dogs 75 which move the test tool off the datum ledge 100 and into engagement with the specific internal load bearing profile 97 of the wellhead. A number of seals 74 are provided to ensure the correct fluid tight seals are provided between the tool and the wellhead.

Figure 6:
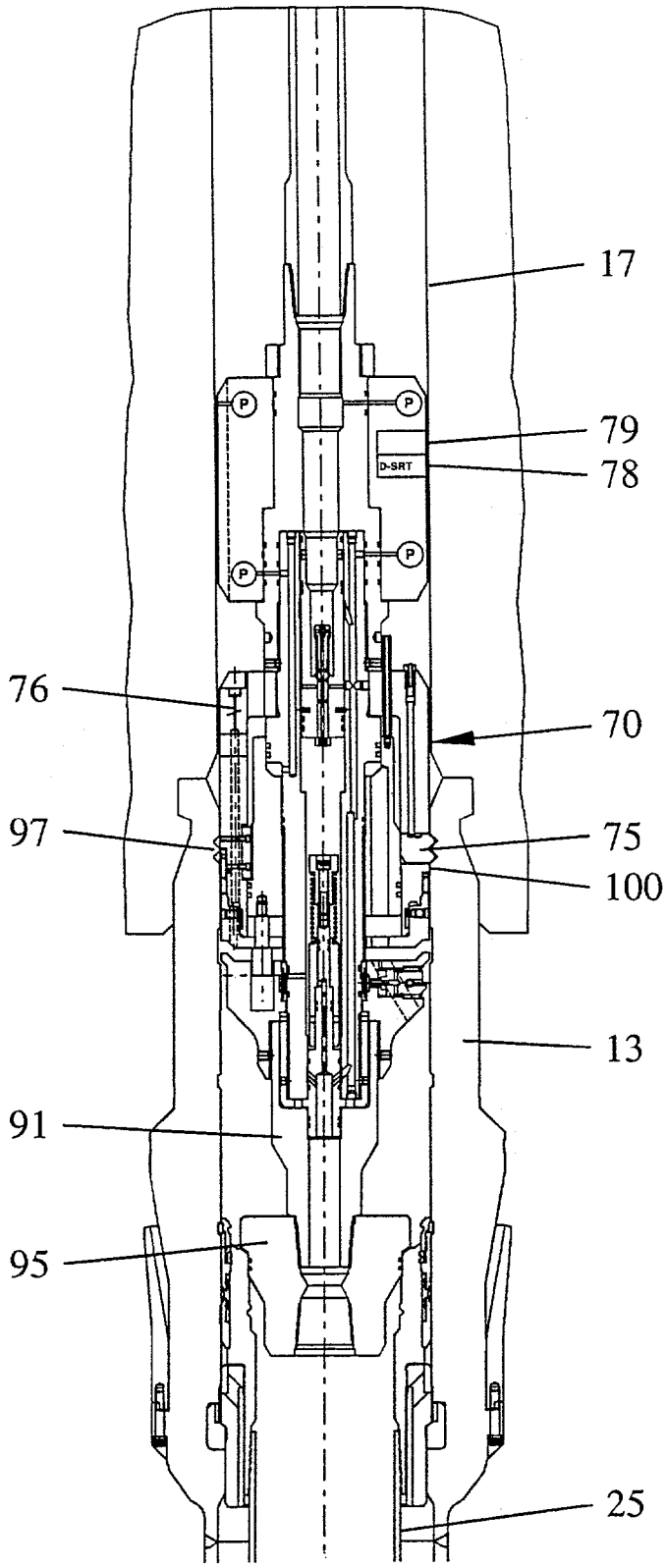
FIG. 6 shows the casing hanger/wellhead function of the wellhead test plug.

FIG. 6 shows the test plug 70 in situ in a wellhead housing 13 and having a hanger test plug 95 attached at its lower end and acting as a nose adaptor on the swivel joint 91 providing engagement with a casing hanger 25. Various adaptors can be used, dependent upon the object which is to be run below the test tool. FIG. 6 also indicates how the dogs 75 engage with the wellhead housing 13 in the load bearing profile 97 rather than at the datum level 100. To test the casing hanger seal assembly or the lower pipe annulus, the bypass plug 83 must be removed, preferably at surface level, to provide a test fluid communication path through the port 76 to the wellhead chamber.

Figure 7:
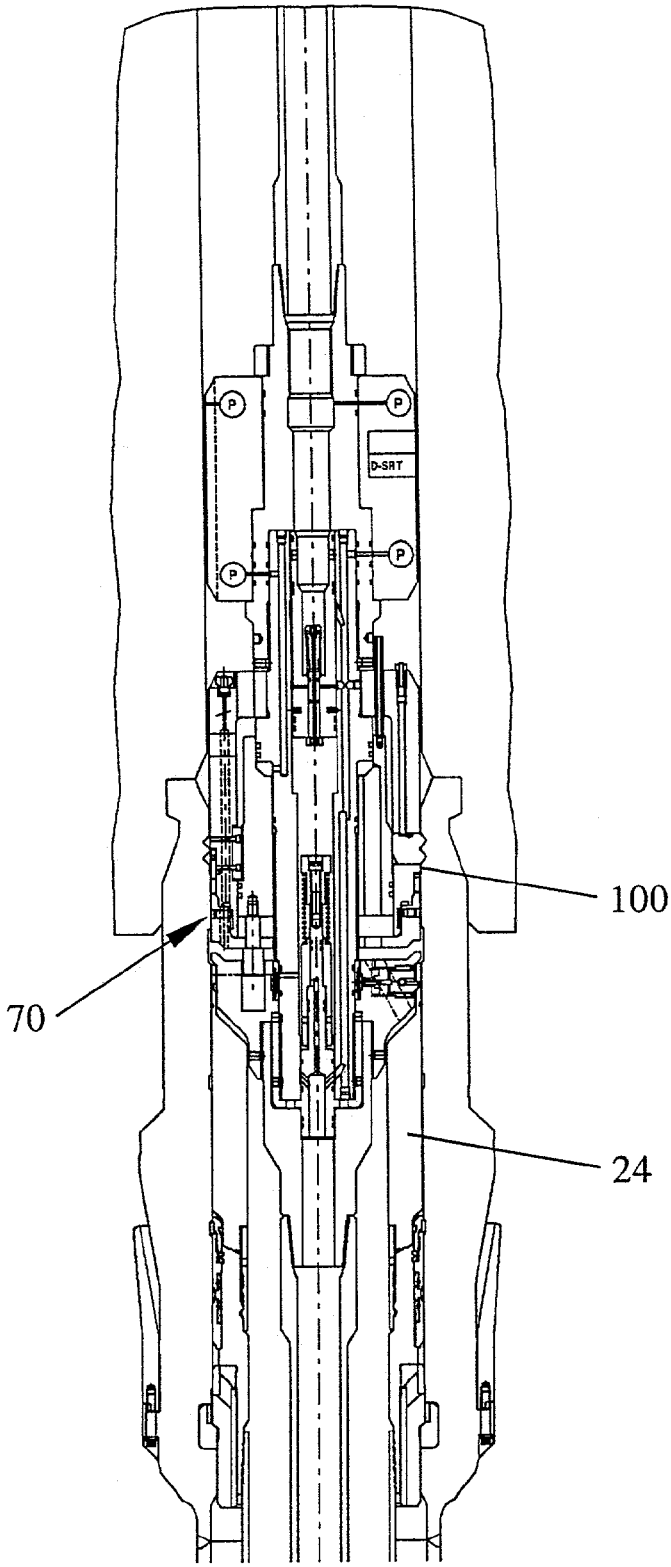
FIG. 7 shows the wear bushing function of the wellhead test plug.

FIG. 7 indicates how the test tool can be used to run or pull a wear bushing 24 as part of the test assembly. To carry out this function, no additional nose attachment is required on the test tool 70.

Figure 8:
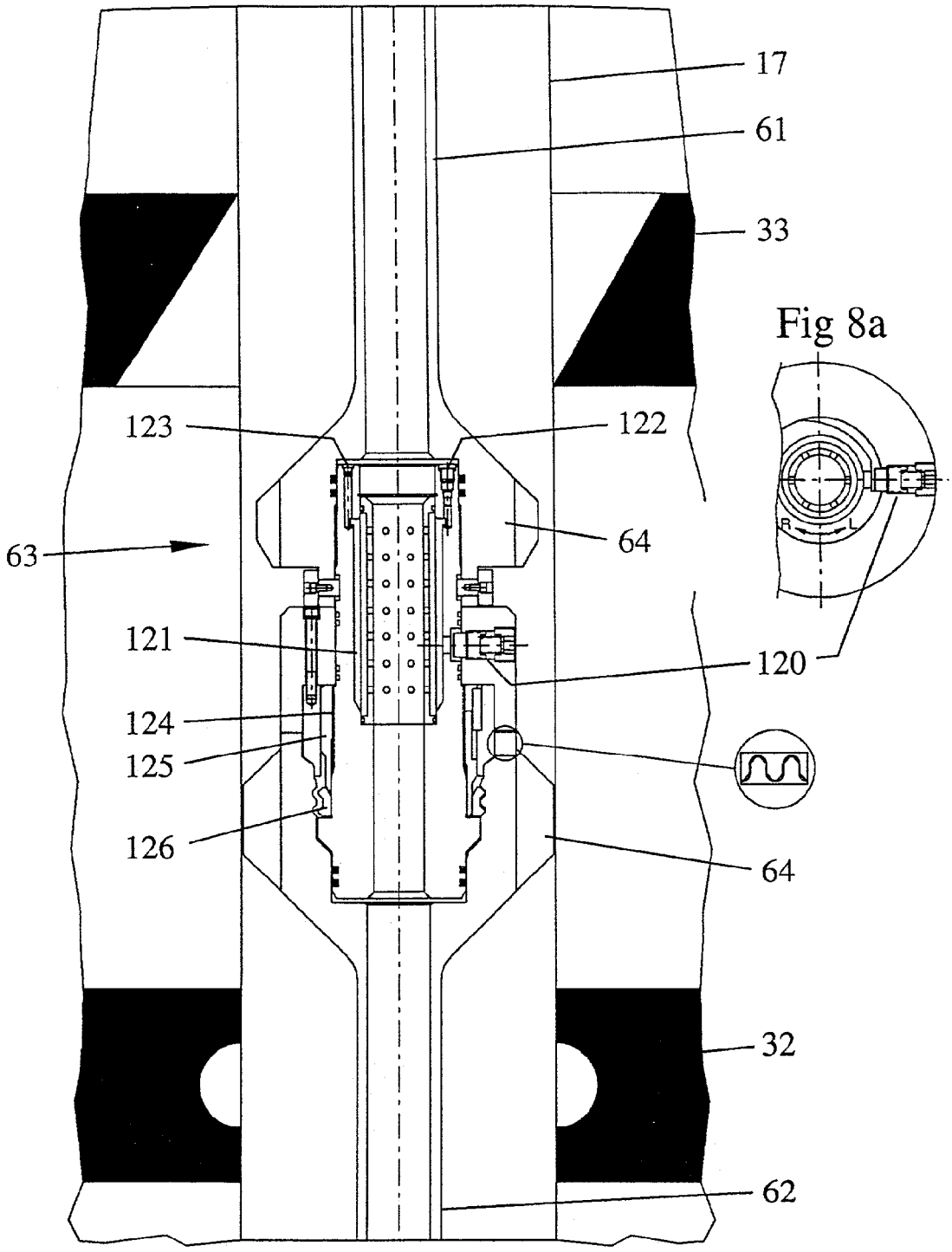
FIG. 8 shows a longitudinal cross sectional view through the mandrel coupling.

FIG. 8 shows, in detail, the construction of the mandrel coupling 63 which joins the upper mandrel 61 and the lower mandrel 62. The shear blind rams 33 are located adjacent to and above the mandrel coupling 63. The coupling is provided with a hydraulically operated anti left hand rotation mechanism which, as can be seen in FIG. 8A which permits right hand rotation but prevents left hand rotation of the upper mandrel 61 relative to the lower mandrel 62. When pressure is applied down the drill pipe into the upper mandrel 61 the anti left hand rotation mechanism 120 is released as the pressure in oil chamber 121 increases. The oil chamber can be serviced on the surface by filing and venting through respective ports 122 and 123. A left hand thread 124 drives a cam 125 which activates a lock ring 126 to engage the upper mandrel 61 to the lower mandrel 62. The release of this left hand thread is only permitted by actuation of the anti left hand rotation mechanism 120.

Figure 9:
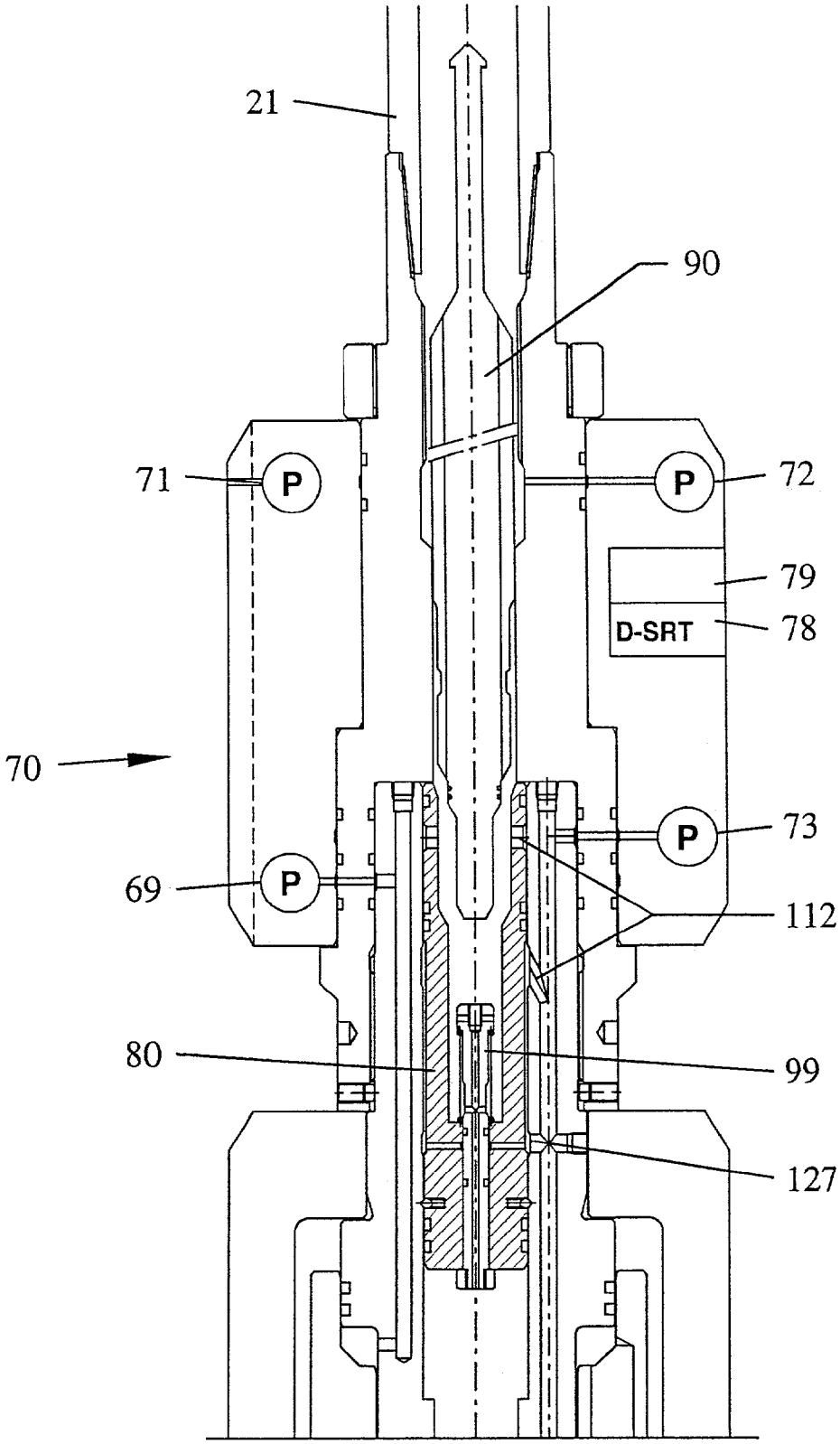
FIG. 9 is a longitudinal cross sectional view showing the drop dart circulation unit prior to opening.
Figure 10:
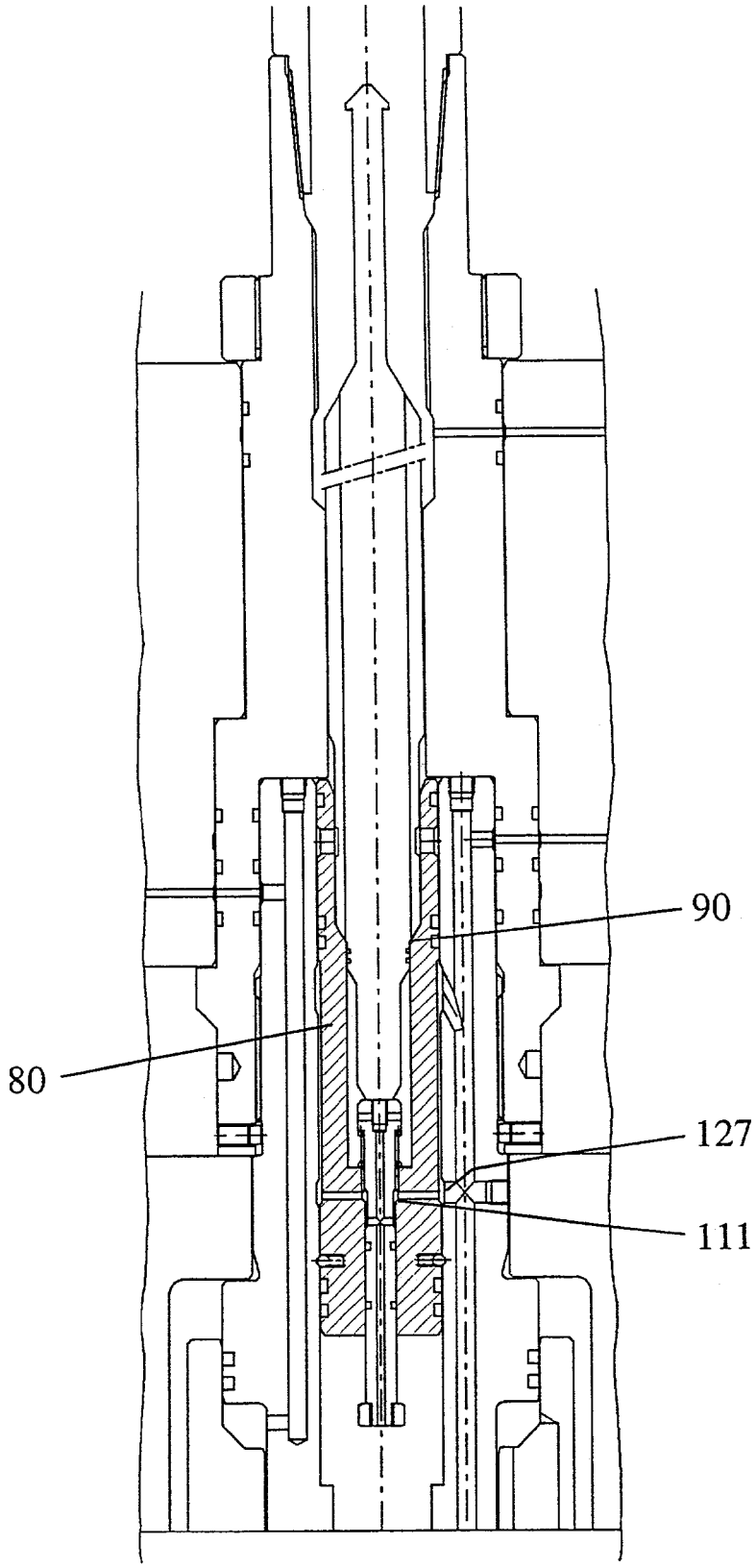
FIG. 10 is a longitudinal cross sectional view showing the drop dart circulation unit with the plunger in the open position.
Figure 11:
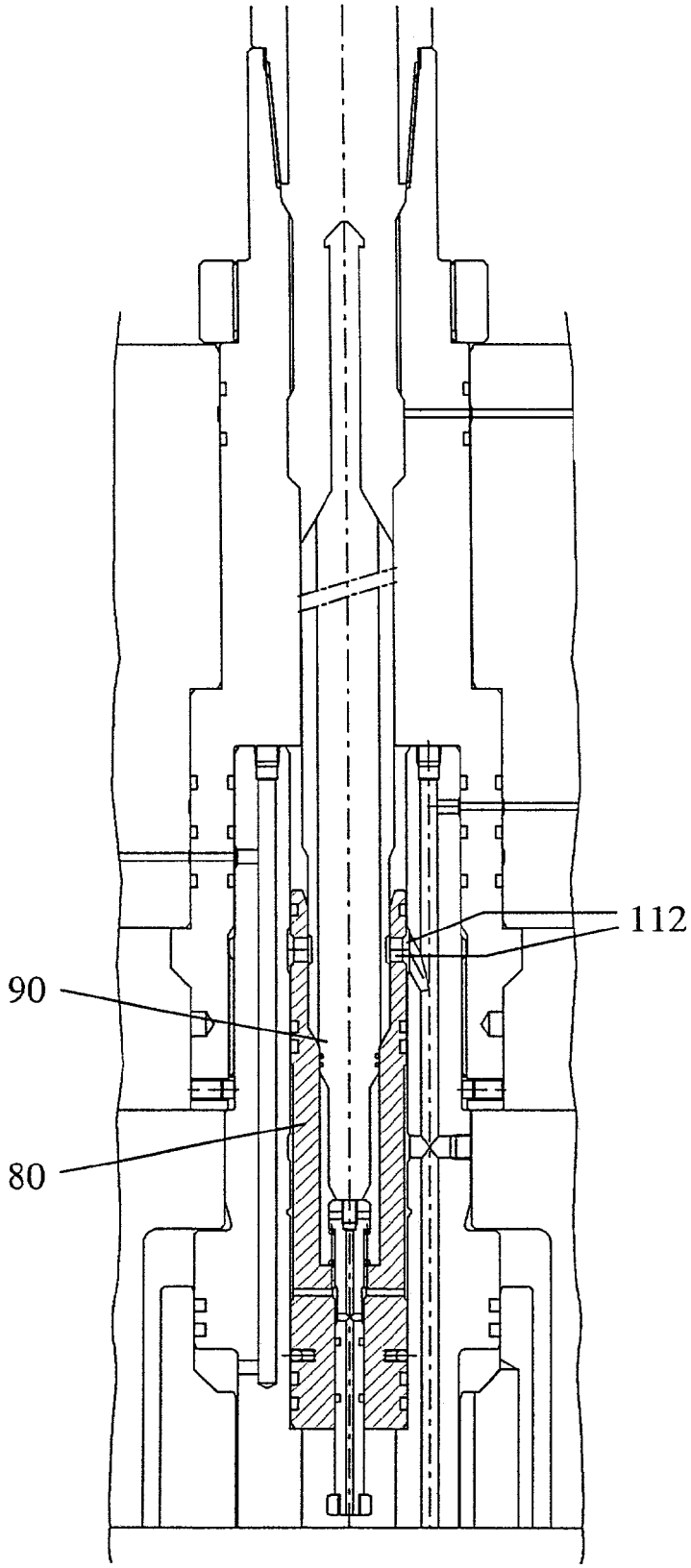
FIG. 11 shows the drop dart circulation unit with full circulation.

In FIG. 9, a more detailed view of the drop dart circulation unit in the test tool 70 is shown. The dart 90 is allowed to drop down the drill pipe and will land and seal in the circulation sleeve 80 thus activating a spring loaded plunger 99 which then vents fluid through passageway 111 from below the dart/sleeve into the circulation port 127 below the tool. The depression of the plunger can be seen in FIG. 10 which also shows how the vent ports 127 open to the plunger 99. FIG. 11 shows how the application of further pressure forces the circulation sleeve 80 to be moved such that the circulation ports 112 are aligned, thereby allowing fluid to bypass the one way upward flow valve 81 and to neutralize the wear bushing hydraulically operated latch dogs. Thus, the well can now be circulated prior to the test tool being tripped out and, as fluid will equalize down the drill pipe, a dry string can be pulled.

Figure 12:
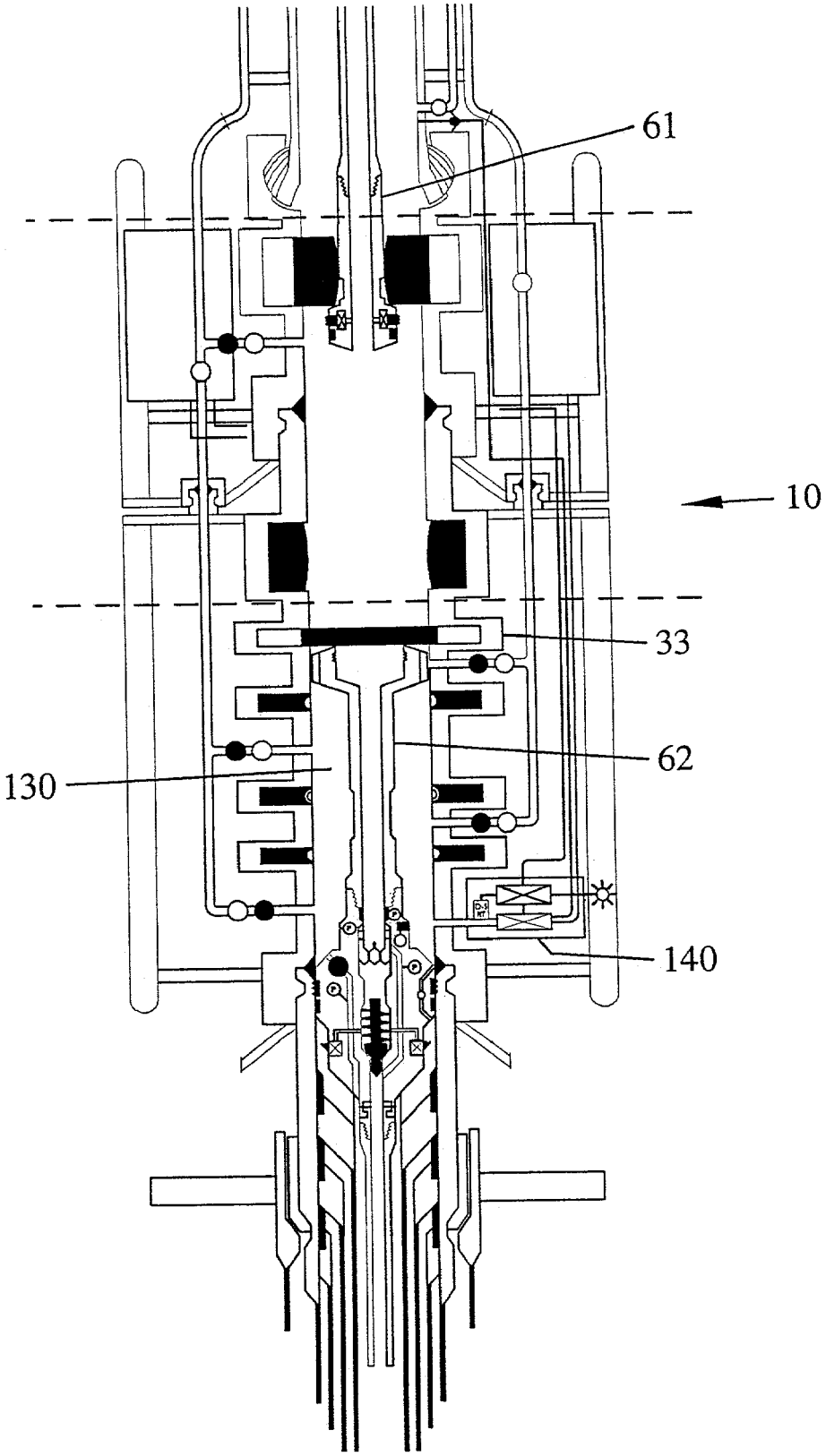
FIG. 12 shows the present invention being used to test the shear blind rams.

FIG. 12 shows the operation of the BOP assembly 10 and the test tool assembly when testing the shear blind rams 33. It will be noted how the mandrel coupling 63 has been released such that the upper mandrel 61 is drawn up thus leaving only the lower mandrel 62 beneath the shear blind rams which have been closed. By closing at least one of the upper and lower choke valves 48, 49, 50, 51 and at least one of the upper and lower kill valves 54, 55, 56, 57 and the valve into the control package 140, a chamber 130 is formed and can be pressured up to the maximum anticipated well pressure. In this way, the integrity of the shear blind rams 33 can be verified in a simple and quick manner.

Figure 13:
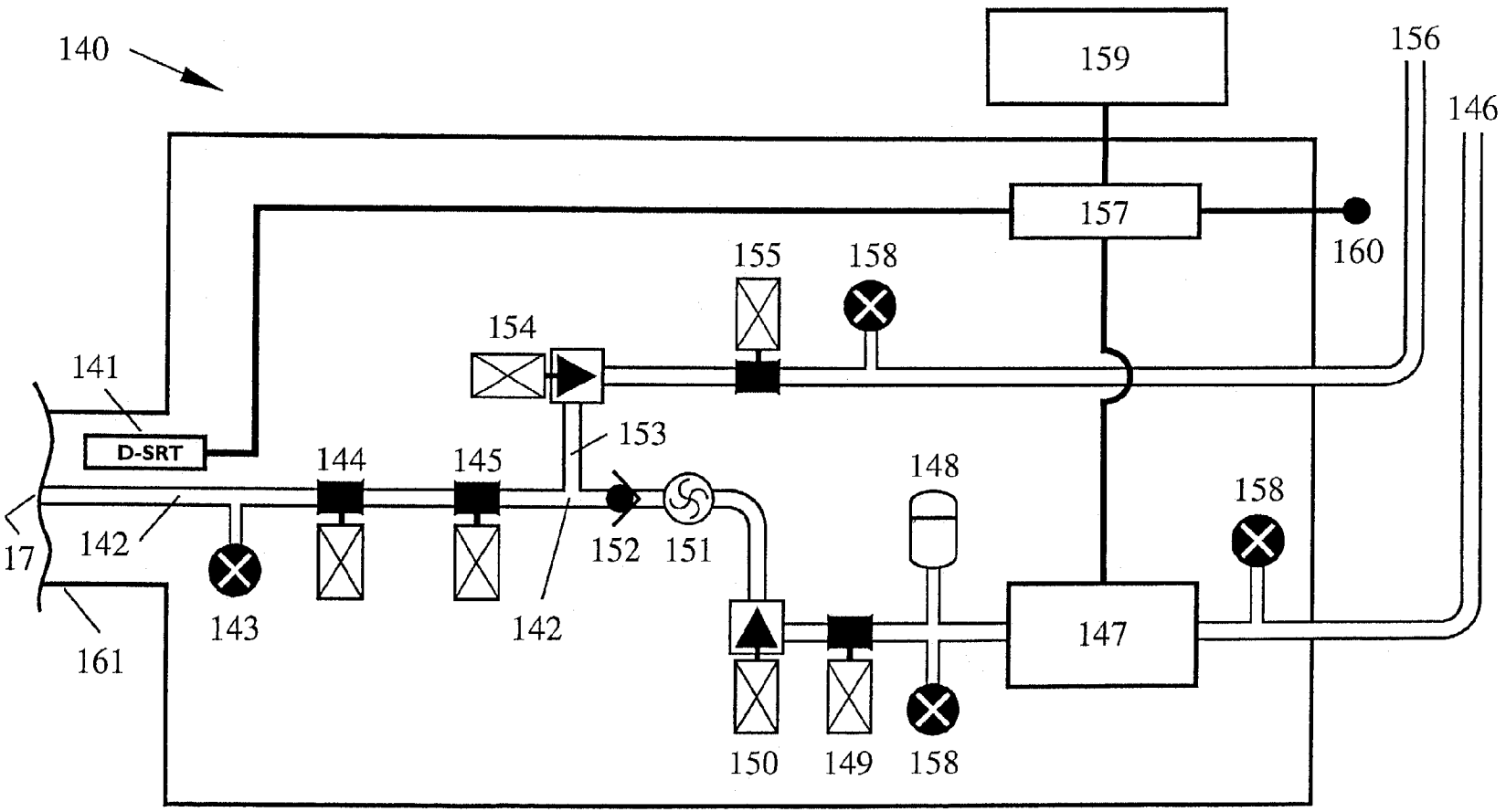
FIG. 13 is a schematic arrangement of the control package of the present invention.

FIG. 13 shows, in detail, a fully encompassing control package 140. A minimum unit could consist of a signal receiver and transmitter unit combined with an electric or hydraulic operated fail closed prime master valve and secondary master valve with a high pressure line for pressuring up and venting down.

The preferred embodiment consists of a data signal receiver and transmitter 141 to communicate with the bore 17 of the BOP. A common two way fluid flow path 142 into the control package from the BOP has the appropriate fluid sensors 143 before the electrical or hydraulically operated fail closed prime master valve 144 and secondary master valve 145.

A hydraulic supply 146 which provides the test fluid initially passes into either a controllable pressure regulator or a pressure intensifier 147 which will provide test fluid at the required pressure. To ensure a reasonable flow when required, a hydraulic accumulator 148 is also present. A controlled failed closed isolation valve 149, an adjustable choke 150 and a volume flow meter 151 allow pressurized flow through a one way flow mechanism 152 into the common two way flow path 142.

The vent or the return path 153 from the common two way flow passes through controlled fail closed choke 154 and isolation valves 155 which regulate the release of fluid into a vent return line 156. This vent line can be connected to the riser bore 19.

An electrical or electric hydraulic means of operating the functions in the control package is provided through a control processor 157. The control processor also communicates with the various sensors 143 and 158, the signal receiver and transmitter 141 and to the surface 159. As an alternative to a mechanical link, an acoustic communication system 160 may be provided. It is possible to change the control package when the BOP bore is isolated via connection 161.

This control package provides a controlled fluid flow with feedback for accurately pressuring up and venting down as required for testing the BOP and wellhead systems, while at the same time, it will fail close if a loss of control is experienced.

Figure 14:
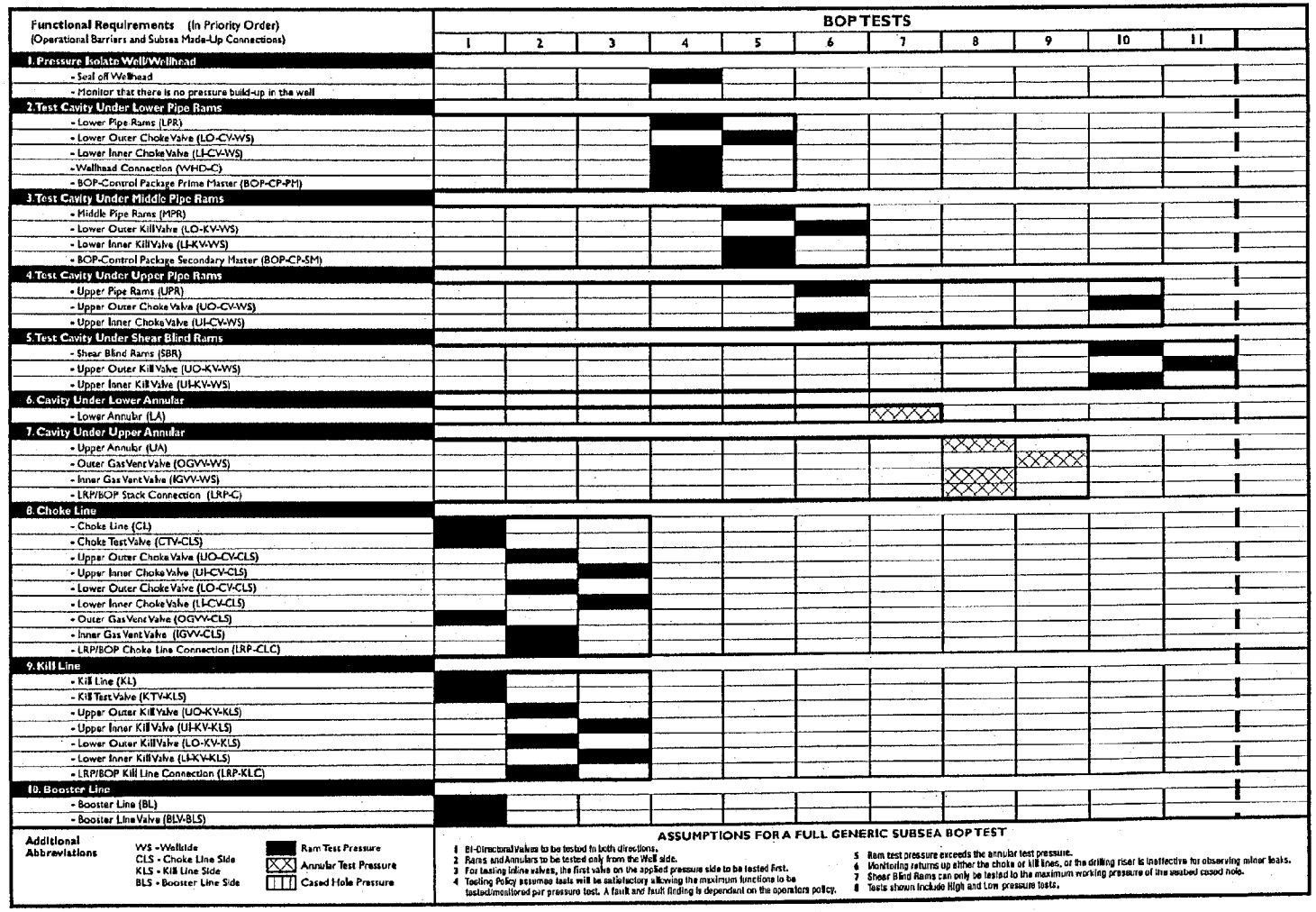
FIG. 14 is a summary of a possible testing scenario using the apparatus of the present invention.

Based on the BOP configuration shown in FIG. 12, an example of the procedure for fully testing the BOP shown is as follows and is summarized in the table of FIG. 14:

(i) The initial simultaneous tests are carried out to check the integrity of: the choke line 40, the choke test valve 47 (choke line side—CLS) and the outer gas vent valve 46 (CLS); the kill line 41 and the kill test valve 52 (kill line side—KLS); and the booster line 42 and the booster line valve 43 (booster line side (BLS). The pressure is monitored in each of the choke, kill and booster lines.

(ii) The second simultaneous tests are concerned with the integrity of the upper 49 and lower 51 outer choke valves (CLS), the inner gas vent valve 45 (CLS) and the LRP (Lower Rise Package)-BOP choke line connection, and with the upper 55 and lower 57 outer kill valves (KLS) and the LRP/BOP kill line connection.

(iii) The next step simultaneously tests the upper 48 and lower 50 inner choke valves (CLS) and the upper 54 and lower 56 inner kill valves (KLS). These tests will check the choke, kilt and booster lines and the associated valving from the line side.

Tests using the assembly can be as follows with certain valves not under test being set to enable any leaks to be monitored independently up either the riser or the choke or kill lines:

(iv) The seal between the test tool and the well head is tested together with the lower pipe rams 30, the lower inner choke valve 50 (well side WS), the well head connector and the control package prime master 144. The inner gas vent 45, the upper 54 and lower 56 inner kill valves and the upper inner choke valve 48 are all in a closed position.

(v) This step checks the lower outer choke valve 51 (WS), the middle pipe rams 31, the lower inner kilt valve 56 (WS) and the control package secondary master valve 145. The inner gas vent 45, the upper inner choke valve 48 and the lower inner kill valve 56 are in closed position.

(vi) The next test examines the integrity of the lower outer kill valve 57 (WS), the upper pipe ram 32 and the upper inner choke valve 48 (WS). The inner gas vent 45, the lower outer choke valve 51 and the upper inner kill valve 54 are all closed.

To test the annular cavities, which can be classed as the medium pressure zone, is as follows:

(vii) The lower annular 34 is tested together with the upper inner kill valve 54 (WS) but this can only be tested to the pressure of the lower annular. The inner gas vent 45, the upper 49 and lower 51 outer choke valve and the lower outer kill valve 57 are all in the closed position.

(viii) This step tests the integrity of the upper annular 35, the inner gas vent valve 45, (WS) and the LRPBOP stack connection and the upper outer kill valve 55 (WS), but only to the annular test pressure. The upper 49 and lower 51 outer choke valves and the lower outer kill valve 57 are all in the closed position.

(ix) This tests only the outer gas vent 46 (WS). The upper 49 and lower 51 outer choke valves, the upper 55 and lower 57 outer kill valves are all in the closed position.

To test the shear blind ram cavity, which is classed as the high pressure zone, is as follows:

(x) The test mandrel 60 is now separated at the coupling 63 between the upper 61 and lower 62 sections so that the shear blind rams 33 can be tested, together with the upper inner kill valve 54 (WS). The outer gas vent 46, the upper 49 and lower 51 outer choke valves and the lower outer kill valve 57 are all in the closed position.

(xi) The final test checks the upper outer kill valve 55 (WS). The outer gas vent 46, the upper 49 and lower 51 outer choke valve and the lower outer kill valve 57 are all in the closed position.

This now ensures that the barrier elements in either the high pressure or medium pressure zones have been tested at their correct working pressure and from both directions where applicable (i.e. rams and annulars are only tested from the well side).

Figure 15:
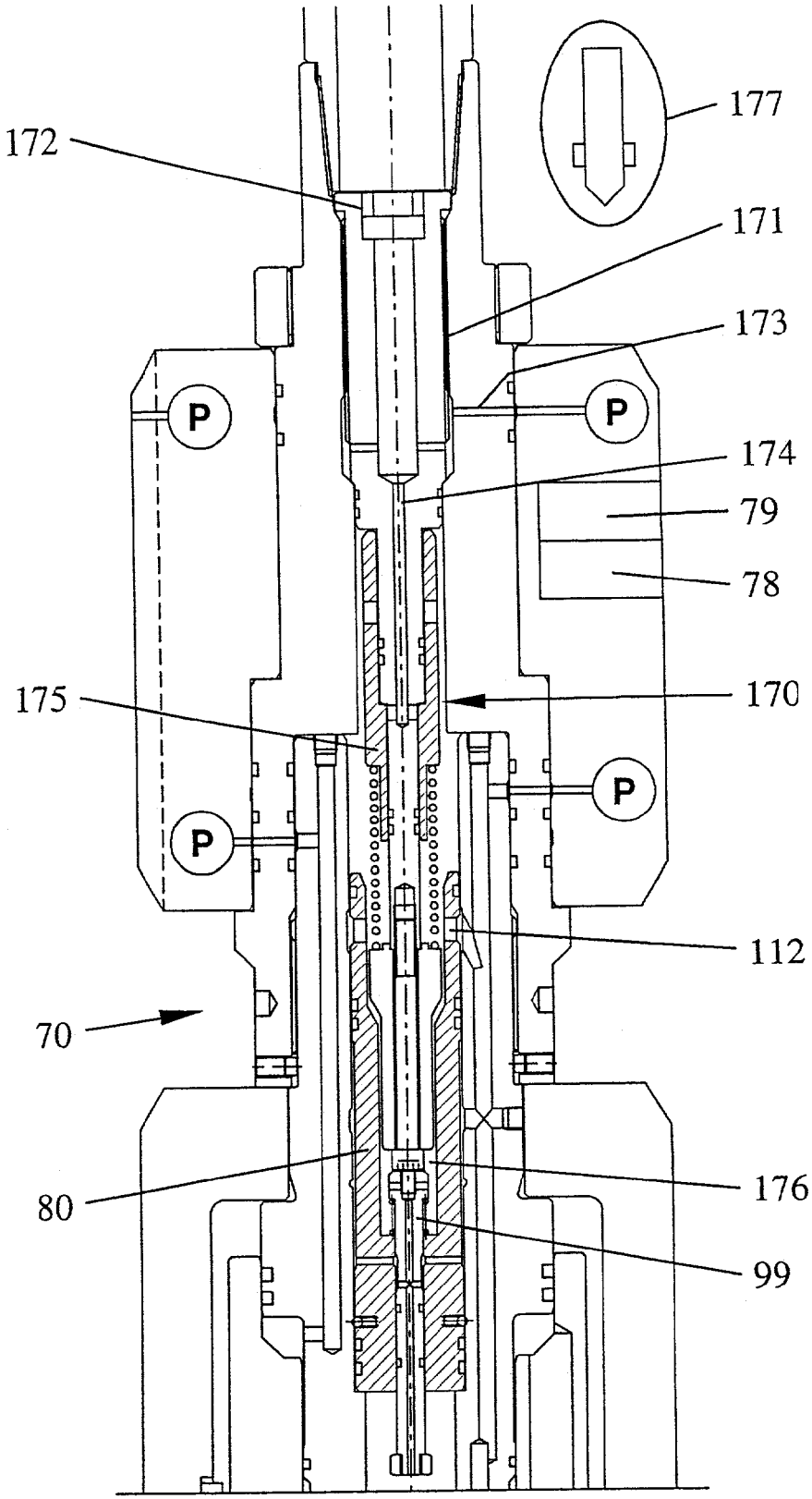
FIG. 15 is a longitudinal cross sectional view showing the test assembly as an emergency planned hang-off tool.

FIG. 15 shows how the test assembly can be adapted to be used as a planned emergency BOP hang-off tool that, on installation, provides a prime bore and annulus barrier in the wellhead. Thus, in this arrangement, the BOP provides a second barrier to the environment in a planned emergency disconnect.

Whilst on the surface, a one way downward differential pressure flow unit 170 is installed, sealed and locked into the test plug 70. On installation, the plunger 99 is depressed and this moves the circulation sleeve 80 into the full circulation mode. This can be achieved by using a long thread section 171 that allows the unit 170 to be screwed in using a connection 172 and a hand tool 177. The one way upward flow mechanism 81 in the lower part of the test plug 70 is now bypassed. This permits circulation down the drill pipe and up the annulus, yet any back pressure up the drill pipe will be contained by the one way downward flow mechanism 170.

The one way downward differential pressure unit 170 provides sufficient pressure differential to allow the release of the hydraulically activated anti-rotation coupling 63.

In a planned emergency disconnector of the BOP lower riser package 15, the adapted test assembly can be locked and sealed in the wellhead which closes off the bore and the annulus from upward pressure. All the sensors in the test assembly can monitor the parameters in the bore and the annulus, above and below the test plug. The pipe rams can be closed. After disconnecting the mandrel coupling 63 and closing the shear blind rams 33, the shear blind rams form the second barrier to the environment. The LRP 15 can now be released.

On return of the drilling vessel and reconnection of the LRP 15, the parameters in the wellhead and the BOP can be obtained prior to operating any function on the BOP stack, reconnecting the mandrel coupling 63, rotating to open valve 77, circulating the well and pulling back the pipe in the hole.

In a hang off situation, there may be no requirement to pull the wear bushing. To prevent this occurring in operation or testing, the wear bushing locking dogs 89 can be made ineffective by locking them in prior to running the test assembly.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

The invention claimed is:

1. An apparatus for testing the bore closure elements in a blow out preventer (BOP) assembly connected to a wellhead, the apparatus comprising:

a shearable test tool assembly disposable within the bore of the BOP assembly;

an electro-control package attached to the outside of the BOP assembly and in fluid communication with the bore of the BOP assembly; and a means for sending and receiving signals between said test tool assembly and said electro-control package.

2. An apparatus according to claim 1, wherein said test tool assembly is locked and sealed into the wellhead by means of a rotation mechanism.

3. An apparatus according to claim 1, wherein said test tool assembly is locked and sealed in the wellhead at a predetermined elevation and can withstand both downward and upward force.

4. An apparatus according to claim 1, further comprising a bore through said test tool assembly and a one way flow mechanism within said test tool assembly bore, allowing free upward flow of fluid and preventing any downward communication of pressure or fluid flow.

5. An apparatus according to claim 4, further comprising a dart which can be passed down through said test tool assembly bore to engage a test assembly test plug such that hydraulic pressure from above opens a two way fluid communication path from above to below the test plug.

6. An apparatus according to claim 1, further comprising a mandrel connected to the test tool assembly; said mandrel having an upper and lower part, the upper and lower parts being joined by a mandrel coupling which is released by rotation.

7. An apparatus according to claim 6, wherein the mandrel coupling can be disconnected to permit a set of shear blind rams to be closed without damaging the mandrel.

8. An apparatus according to claim 1, wherein said electro-control package has independent sensing means for monitoring the parameters in the BOP bore above the wellhead.

9. An apparatus according to claim 8, wherein the parameters include one of the following: pressure, temperature, velocity, density and phase detection.

10. An apparatus according to claim 9, wherein the phase detection can be one of the following: drilling mud, cement, gas, oil, water and completion fluid.

11. An apparatus for testing the bore closure elements in a blow out preventer (BOP) assembly connected to a wellhead, the apparatus comprising:

a shearable test tool assembly disposable within the bore of the BOP assembly;

an electro-control package attached to the outside of the BOP assembly and in fluid communication with the bore of the BOP assembly; and a means for sending and receiving signals between said test tool assembly and said electro-control package, wherein said test tool assembly is provided with one or more nose adaptors for interfacing with different components placed in the wellhead for testing.

12. An apparatus for testing the bore closure elements in a blow out preventer (BOP) assembly connected to a wellhead, the apparatus comprising:

a shearable test tool assembly disposable within the bore of the BOP assembly;

an electro-control package attached to the outside of the BOP assembly and in fluid communication with the bore of the BOP assembly; and a means for sending and receiving signals between said test tool assembly and said electro-control package; and a test mandrel adapted to engage one of the bore closure elements of the BOP.

13. An apparatus for testing the bore closure elements in a blow out preventer (BOP) assembly connected to a wellhead, the apparatus comprising:

a shearable test tool assembly disposable within the bore of the BOP assembly;

an electro-control package attached to the outside of the BOP assembly and in fluid communication with the bore of the BOP assembly; and a means for sending and receiving signals between said test tool assembly and said electro-control package; and a hydraulically operated anti-rotational release coupling mechanism.

14. An apparatus for testing the bore closure elements in a blow out preventer (BOP) assembly connected to a wellhead, the apparatus comprising:

a shearable test tool assembly disposable within the BOP assembly;

an electro-control package adapted for attachment to the BOP assembly;

a means for sending and receiving signals between said test tool assembly and said electro-control package; and a hydraulically operated anti-rotational release coupling mechanism, wherein the hydraulically operated anti-rotational mechanism overrides pressuring up against a downward hydraulic barrier mechanism in the test assembly allowing rotation to release the coupling release coupling mechanism is actuated by a downward hydraulic barrier mechanism in the test assembly, allowing rotation to release the coupling.

15. An apparatus according to claim 14, wherein the coupling has a self sealing cam make up/release mechanism.

16. An apparatus for testing the bore closure elements in a blow out preventer (BOP) assembly connected to a wellhead, the apparatus comprising:

a shearable test tool assembly disposable within the BOP assembly;

an electro-control package adapted for attachment to the BOP assembly;

a means for sending and receiving signals between said test tool assembly and said electro-control package;

a bore through said test tool assembly;

a one way flow mechanism within said test tool assembly bore, allowing free upward flow of fluid and preventing any downward communication of pressure or fluid flow; and a one way downflow unit to allow circulation down the bore but which contains bore pressure from below.

17. An apparatus according to claim 16, wherein the one way down flow unit forms a prime pressure barrier in the wellhead.

18. An apparatus according to claim 16, wherein the one way down flow unit allows circulation up an annulus.

19. An apparatus for testing the bore closure elements in a blow out preventer (BOP) assembly connected to a wellhead, the apparatus comprising:

a shearable test tool assembly disposable within the BOP assembly;

an electro-control package adapted for attachment to the BOP assembly;

a means for sending and receiving signals between said test tool assembly and said electro-control package;

a hydraulically operated anti-rotational release coupling mechanism; and a differential pressure downward circulation means to permit disconnection of the anti rotational release coupling mechanism.

20. An apparatus for testing a BOP connected to a wellhead and having a plurality of wellbore closure members including at least one blind ram, the apparatus comprising:

a wellhead test plug adapted to sealingly connect to the wellhead;

a lower mandrel having a lower end attached to said wellhead test plug and an upper end disposed below the blind ram;

an upper mandrel having a lower end removably attached to said lower mandrel and an upper end connected to a drillstring extending up the wellbore, wherein said upper mandrel can be disconnected from said lower mandrel while said wellhead test plug is connected to the wellhead;

a plurality of sensors disposed in said wellhead test plug; and a signal relay device adapted to transmit data from said plurality of sensors to a control package coupled to the BOP, wherein the control package is disposed outside of the wellbore.

21. The apparatus of claim 20 further comprising a mandrel coupling removably attaching said lower mandrel to said upper mandrel, wherein said mandrel coupling is positioned adjacent to and below the blind ram.

22. The apparatus of claim 20 further comprising a nose adapter connected to said wellhead test plug, wherein said nose adapter is operable to engage a casing hanger supported by the wellhead.

23. The apparatus of claim 20 further comprising a control package connected to the BOP and adapted to provide hydraulic fluid to the wellbore.

24. The apparatus of claim 20, further comprising a bore through said wellhead test plug and said mandrels; and a one way flow mechanism disposed within said bore and adapted to allow free upward flow of fluid and prevent downward communication of pressure or fluid flow.

25. The apparatus of claim 20 further comprising a selectively openable bypass disposed in said wellhead test plug.

26. The apparatus according to claim 25, further comprising a dart adapted to engage said wellhead test plug so as to open the bypass and allow two-way fluid communication from above to below the wellhead test plug.

27. An apparatus for testing a BOP connected to a wellhead and having a plurality of wellbore closure members including at least one blind ram, the apparatus comprising:

a wellhead test plug adapted to sealingly connect to the wellhead;

a lower mandrel having a lower end attached to said wellhead test plug and an upper end disposed below the blind ram;

an upper mandrel having a lower end removably attached to said lower mandrel and an upper end connected to a drillstring extending up the wellbore;

a plurality of sensors disposed in said wellhead test plug;

a signal relay device adapted to transmit data from said plurality of sensors to a control package coupled to the BOP; and a one-way downflow unit to allow circulation down the wellbore through the wellhead test plug but which contains bore pressure from below.

28. The apparatus according to claim 27, wherein the one-way downflow unit forms a prime pressure barrier in the wellhead.

29. The apparatus according to claim 27, wherein the one-way downflow unit allows circulation up an annulus inside the wellbore.

* * * * *